US007983580B2

(12) United States Patent
Kim et al.

(10) Patent No.: US 7,983,580 B2
(45) Date of Patent: Jul. 19, 2011

(54) IMAGE FORMING APPARATUS AND CONTROL METHOD THEREOF

(75) Inventors: Jeong-Hwan Kim, Gunsan-si (KR); Myung-Ho Kyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 42 days.

(21) Appl. No.: 12/511,127

(22) Filed: Jul. 29, 2009

(65) Prior Publication Data

US 2010/0046969 A1 Feb. 25, 2010

(30) Foreign Application Priority Data

Aug. 22, 2008 (KR) ..... 10-2008-0082494

(51) Int. Cl.
*G03G 15/16* (2006.01)

(52) U.S. Cl. ..... 399/66; 399/45

(58) Field of Classification Search ..... 399/66, 399/45, 302, 308, 314
See application file for complete search history.

(56) References Cited

U.S. PATENT DOCUMENTS

| | | | | |
|---|---|---|---|---|
| 6,859,630 | B2 * | 2/2005 | Matsuda et al. | 399/66 |
| 2004/0091277 | A1 * | 5/2004 | Miyamoto et al. | 399/66 X |
| 2008/0131156 | A1 * | 6/2008 | Brockman et al. | 399/66 |
| 2009/0003895 | A1 * | 1/2009 | Yamauchi et al. | 399/313 |
| 2009/0290889 | A1 * | 11/2009 | Tsukamura et al. | 399/45 |

FOREIGN PATENT DOCUMENTS

| | | | |
|---|---|---|---|
| JP | 2001-051527 | A * | 2/2001 |
| JP | 2001-083812 | A * | 3/2001 |
| JP | 2001-331075 | A * | 11/2001 |
| JP | 2002-258714 | A * | 9/2002 |
| JP | 2006-337578 | | 12/2006 |

* cited by examiner

*Primary Examiner* — Sophia S Chen
(74) *Attorney, Agent, or Firm* — Stanzione & Kim, LLP

(57) ABSTRACT

An image forming apparatus and a control method thereof to improve quality of an image in consideration of a change in posture of a print media. The image forming apparatus can include a transferred unit on which a visible image is formed, a transferring unit to form a transfer region through which the visible image is transferred onto a print medium, along with the transferred unit, a bias supplying unit to supply bias to the transferring unit so that a transfer electric field is produced in the transfer region, and a controller to control the bias supplying unit to supply different first to third biases to the transferring unit while at least first to third regions of the print medium pass through the transfer region, respectively.

21 Claims, 19 Drawing Sheets

IMAGE FORMING APPARATUS AND CONTROL METHOD THEREOF

CROSS-REFERENCE TO RELATED APPLICATIONS

This application claims priority from Korean Patent Application No. 10-2008-0082494, filed on Aug. 22, 2008 in the Korean Intellectual Property Office, the disclosure of which is incorporated herein by reference in its entirety

BACKGROUND

1. Field of the Inventive Concept

An apparatus and a method of the present general inventive concept relate to an image forming apparatus and a control method thereof, and more particularly, to an image forming apparatus and a control method thereof to improve quality of an image when a change in posture of a print media occurs.

2. Description of the Related Art

An image forming apparatus refers to an apparatus for forming an image corresponding to print data on print paper and encompasses a copy machine, a printer, a scanner, a facsimile, a multifunction copier with integrated functions of these machines, or other machines.

FIG. 1 shows a path of a print medium which is being conveyed according to a single-sided print mode in an electro-photographic image forming apparatus 1 employing an indirect electro-photographic system.

A print medium picked up by a pickup roller (not illustrated) is conveyed between a transferred unit 20 and a transferring unit 10 through a feed roller 2 and a registration roller 3. A visible image formed of a toner is formed on an image carrier 5. The transferred unit 20 includes an intermediate transfer belt 21, driving rollers 23, 24 and 25 for driving the intermediate transfer roller 21, and a transfer belt roller 22 for transferring the visible image of the image carrier 5 onto the intermediate transfer belt 21.

The visible image transferred onto the intermediate transfer belt 21 of the transferred unit 20 is transferred into the print medium passing between the transferred unit 20 and the transferring unit 10. In other words, when a voltage supplying unit (not illustrated) applies a transfer voltage having the opposite polarity to the toner to the transferring unit 10, a transfer electric field is produced between the transferred unit 20 and the transferring unit 10. The toner forming the visible image is transferred onto the print medium by this transfer electric field.

The visible image transferred onto the print medium is fixed on the print medium while passing through a fixing unit 13 and is discharged through discharge rollers 14 and 15 to the outside.

Here, while the print medium passes through the transferred unit 20 and the transferring unit 10, a posture, that is, an entrance angle, of the print medium may be changed. Such change of the entrance angle of the print medium may be caused by a variety of factors including a difference in rotation speed between multiple rollers arranged before and after pass of the print medium through the transferred unit 20 and the transferring unit 10, ambient environment conditions (temperature/humidity), thickness of the print medium, etc. When the entrance angle of the print medium is changed, a feature of transfer of the toner onto the print medium by the transfer electric field may be varied, which may result in an effect on print quality. Further, such change of the entrance angle may cause image defects such as variation of concentration of the image formed on the print medium, lack of toner in a portion of the image, etc.

FIG. 2 shows a double-sided print path of the image forming apparatus 1 of FIG. 1, in which the single-sided printed print medium is conveyed along a double-sided print path DP as the discharge roller 14 is reversely rotated. When the conveyed print medium again passes between the transferred unit 20 and the transferring unit 10 by means of a conveying roller 4 and the registration roller 3, a new visible image is formed on a rear side of the print medium.

Comparing the print paths of FIGS. 1 and 2, it is apparent that the double-sided print path DP is more curved than a single-sided print path SP. Accordingly, when the print medium conveyed along the double-sided print path passes through the transferred unit 20 and the transferring unit 10, a posture of the print medium may be changed in a pattern different from that in the single-sided print and an image defect or a change in concentration of an image may be caused in a manner different from that of the single-sided print.

SUMMARY

The present general inventive concept can provide an image forming apparatus and a control method thereof to improve quality of an image when a change in posture of a print media occurs in the image forming apparatus.

The present general inventive concept can also provide an image forming apparatus and a control method thereof to adjust concentration of an image formed on a printed medium.

Additional embodiments of the present general inventive concept will be set forth in part in the description which follows and, in part, will be obvious from the description, or may be learned by practice of the present general inventive concept.

An example embodiment of the present general inventive concept can be achieved by providing an image forming apparatus including a transferring unit to form a visible image on a transferred medium, a bias supplying unit to supply bias to the transferring unit, and a controller to control the bias supplying unit to supply first to third biases to the transferring unit to form the visible image on the transferred medium.

The controller may control the bias supplying unit to supply the first to third biases to the transferring unit while at least first to third regions of the transferred medium pass a transfer region at which the visible image is formed, respectively.

The first to third regions may correspond to a leading end region, a middle region and a tail end region of the transferred medium on the basis of a travel direction of the transferred medium, and an absolute value of the second bias may be larger than an absolute value of the first bias and an absolute value of the third bias may be smaller than the absolute value of the first bias.

The first to third regions may correspond to a leading end region, a middle region and a tail end region of the transferred medium on the basis of a travel direction of the transferred medium, and an absolute value of the second bias may be larger than an absolute value of the first bias and an absolute value of the third bias may be larger than the absolute value of the second bias.

The first to third regions may correspond to a leading end region, a middle region and a tail end region of the transferred medium on the basis of a travel direction of the transferred medium, and an absolute value of the second bias may be smaller than an absolute value of the first bias and an absolute value of the third bias may be smaller than the absolute value of the second bias.

The first to third biases may be capable of being varied depending on at least one of ambient temperature/humidity, thickness of the transferred medium, use time of the transferring unit and a print mode of the transferred medium.

Exemplary embodiments of the present general inventive concept can also be achieved by providing an image forming apparatus including a transferred unit on which a visible image is formed, a transferring unit to form a transfer region through which the visible image is transferred onto a print medium, along with the transferred unit, a bias supplying unit to supply bias to the transferring unit so that a transfer electric field is produced in the transfer region nip, and a controller to control the bias supplying unit to supply different biases to the transferring unit in correspondence to a change of posture of the print medium while the print medium passes through the transfer region nip.

When one region of the print medium deviates from a normal path and passes through the transfer region along an over-transfer path near the transferring unit, the controller may control the bias supplying unit to supply a second bias having an absolute value smaller than that of a first bias of the normal path to the transferring unit.

The second bias may be varied depending on at least one of ambient temperature/humidity, thickness of the print medium, use time of the transferring unit and a print mode of the print medium.

When one region of the print medium deviates from a normal path and passes through the transfer region along an under-transfer path near the transferring unit, the controller may control the bias supplying unit to supply a third bias having an absolute value larger than that of the first bias of the normal path to the transferring unit.

Exemplary embodiments of the present general inventive concept can also be achieved by providing a control method of an image forming apparatus including a transferred unit on which a visible image is formed, and a transferring unit to form a transfer region through which the visible image is transferred onto a print medium, along with the transferred unit, the control method including sensing an attribute of the print medium, and supplying different first to third biases to the transferring unit while at least first to third regions of the print medium pass through the transfer region nip, according to the attribute of the print medium.

The at least first to third regions of the print medium may be divided based on whether an entrance angle of the print medium into the transfer region and the transfer electric field are changed while the print medium passes through the transfer region nip.

The first to third regions may correspond to a leading end region, a middle region and a tail end region of the print medium on the basis of a travel direction of the print medium, and an absolute value of the second bias may be larger than an absolute value of the first bias and an absolute value of the third bias may be smaller than the absolute value of the first bias.

The first to third regions may correspond to a leading end region, a middle region and a tail end region of the print medium on the basis of a travel direction of the print medium, and an absolute value of the second bias may be larger than an absolute value of the first bias and an absolute value of the third bias may be larger than the absolute value of the second bias.

The first to third regions may correspond to a leading end region, a middle region and a tail end region of the print medium on the basis of a travel direction of the print medium, and an absolute value of the second bias may be smaller than an absolute value of the first bias and an absolute value of the third bias may be smaller than the absolute value of the second bias.

The first to third biases may be varied depending on at least one of ambient temperature/humidity, thickness of the print medium, use time of the transferring unit and a print mode of the print medium.

Exemplary embodiments of the present general inventive concept can also be achieved by providing a control method of an image forming apparatus including a transferred unit on which a visible image is formed, and a transferring unit to form a transfer region through which the visible image is transferred onto a print medium, along with the transferred unit, the control method including applying a first bias to the transferring unit, maintaining the first bias in the transferring unit if a posture of the print medium is not changed, and applying a second bias different from the first bias to the transferring unit if the posture of the print medium is changed.

When one region of the print medium deviates from a normal path and passes through the transfer region along an over-transfer path near the transferring unit, the applying a second bias may include applying second bias having an absolute value smaller than that of the first bias to the transferring unit.

The second bias may be varied depending on at least one of ambient temperature/humidity, thickness of the print medium, use time of the transferring unit and a print mode of the print medium.

When one region of the print medium deviates from a normal path and passes through the transfer region along an under-transfer path near the transferring unit, the applying second bias may include applying a third bias having an absolute value larger than that of the first bias to the transferring unit.

Exemplary embodiments of the present general inventive concept can also be achieved by providing a transfer unit of an image forming apparatus, including a transfer region to transfer an image to a print medium, and a bias supplying unit to selectively apply a plurality of transfer biases to the transfer region based on an attribute of the print medium passing through the transfer region.

The attribute can include at least one of an entrance angle of the print medium, a distance from the transfer region to a leading edge of the print medium, a print mode of the image forming apparatus, a thickness of the print medium, a speed of the image forming apparatus, and an ambient condition of the image forming apparatus.

The transfer unit can further include guide plates to control the entrance angle of the print medium.

The transfer unit can further include an input unit to receive an input signal from a user, and a controller to control the bias supplying unit based on the input signal.

Exemplary embodiments of the present general inventive concept can also be achieved by providing a method of transferring an image to a print medium, the method including selectively applying a plurality of transfer biases to a transfer region based on an attribute of the print medium passing through the transfer region.

BRIEF DESCRIPTION OF THE DRAWINGS

Exemplary embodiments of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
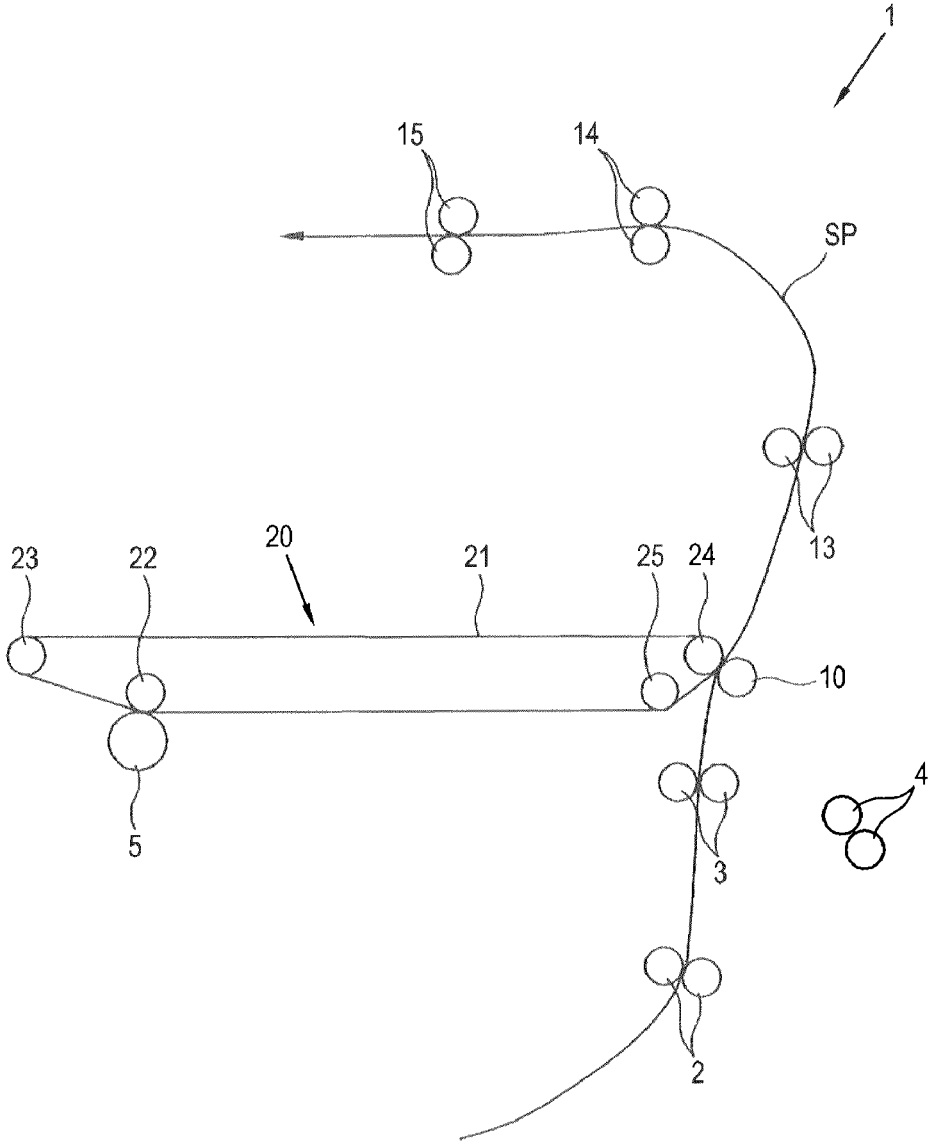
FIG. 1 (RELATED ART)
FIG. 1 is a schematic view illustrating a convey path of a print medium along a single-sided print path of a conventional image forming apparatus.
Figure 2:
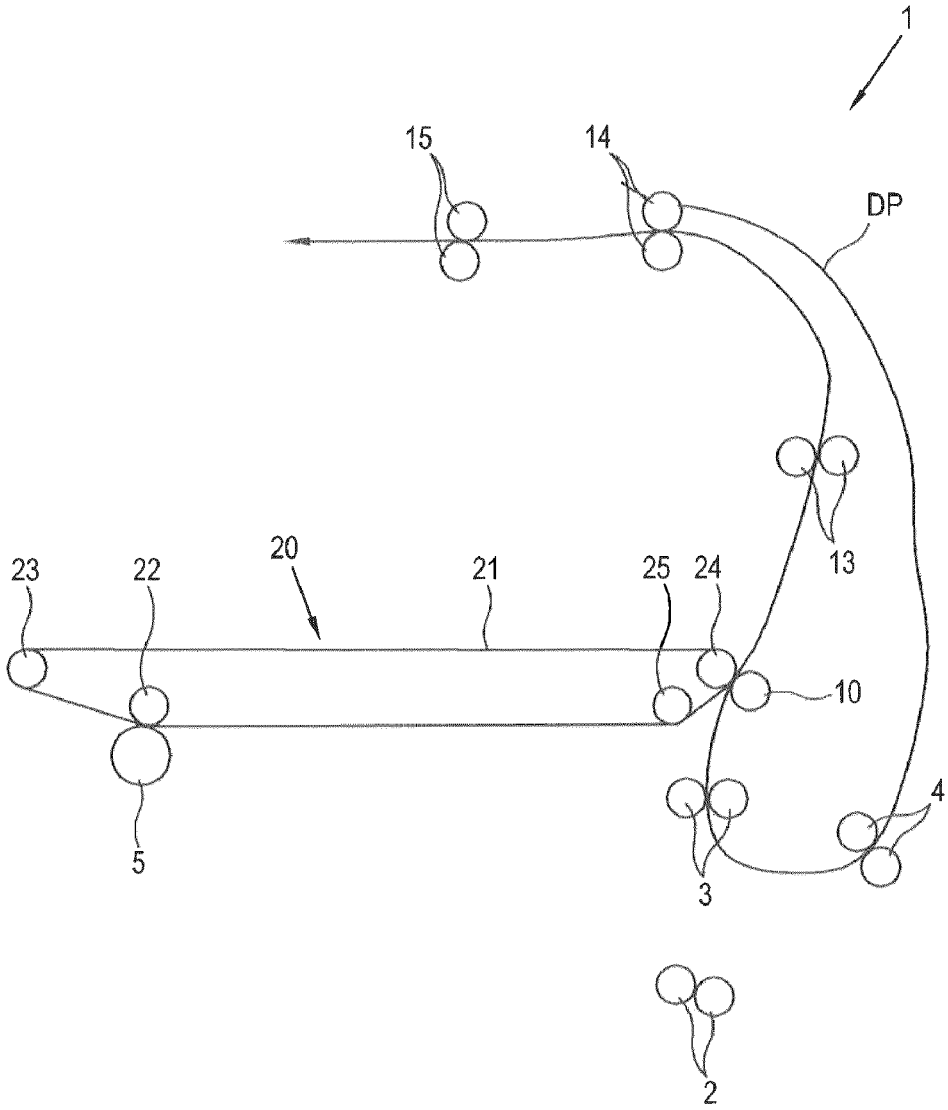
FIG. 2 (RELATED ART)
FIG. 2 is a schematic view Illustrating a convey path of a print medium along a double-sided print path of the image forming apparatus of FIG. 1.

Reference will now be made in detail to the embodiments of the present general inventive concept, examples of which are illustrated in the accompanying drawings, wherein like reference numerals refer to like elements throughout. The embodiments are described below so as to explain the present invention by referring to the figures.

In the following description, an image forming apparatus 100 employing an indirect electro-photographic system will be described by way of an example.

Figure 3:
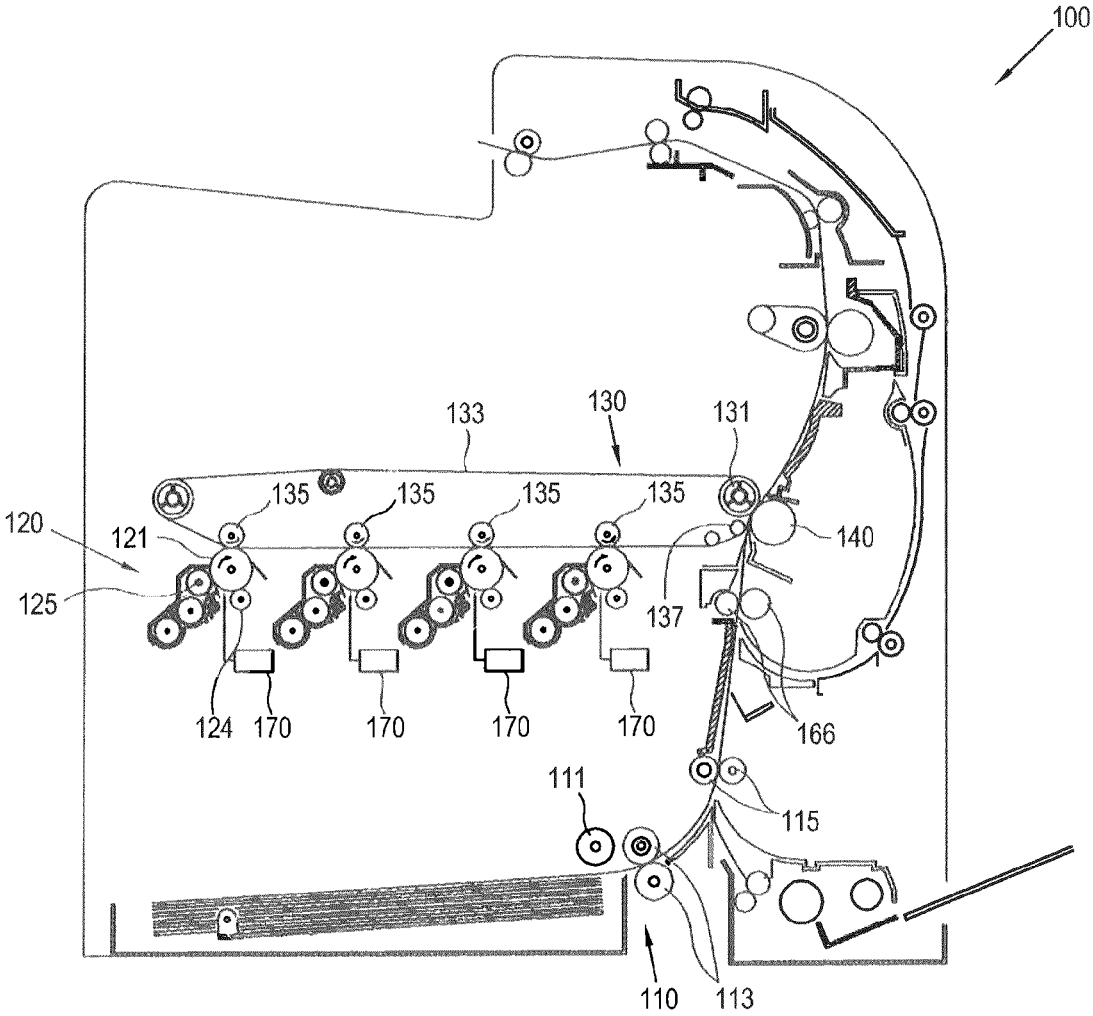
FIG. 3 is a schematic sectional view of an image forming apparatus according to an embodiment of the present general inventive concept.
Figure 4:
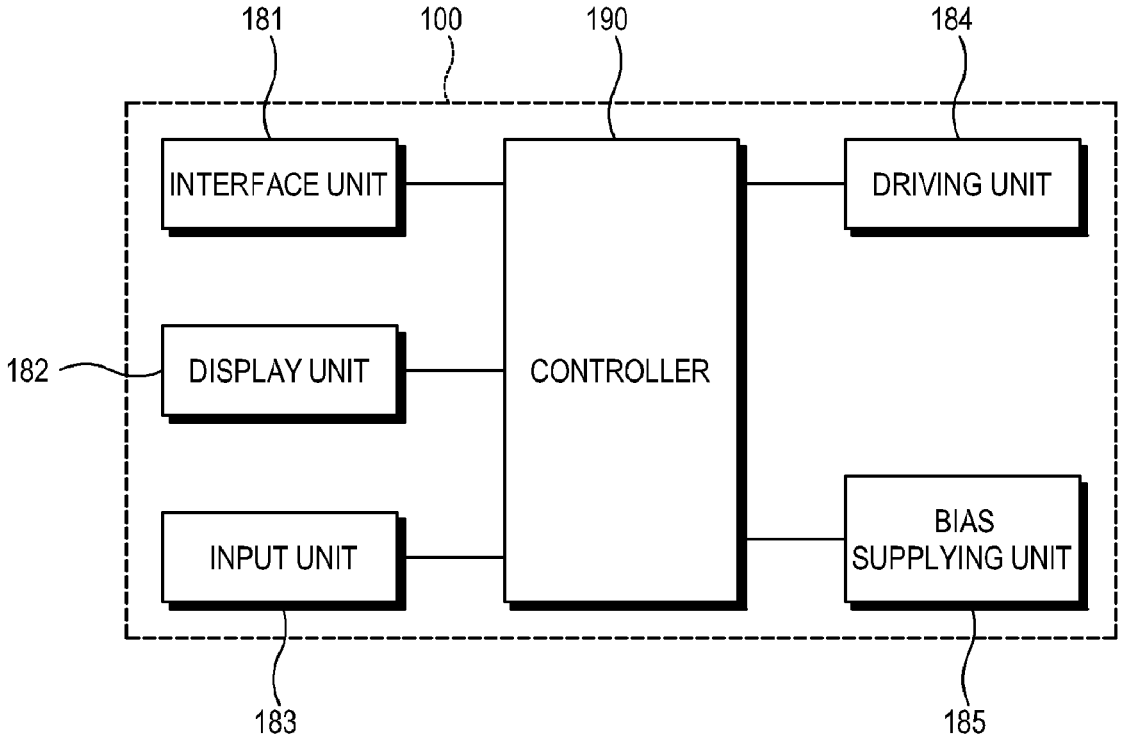
FIG. 4 is a schematic block diagram of the image forming apparatus of FIG. 3.

As illustrated in FIGS. 3 and 4, the image forming apparatus 100 according to an embodiment of the present general inventive concept can include development cartridges 120, an exposure unit 170, a transferred unit 130, a transferring unit 140, a bias supplying unit 185 and a controller 190.

Each of the development cartridges 120 can include a charging roller 124, an image carrier 121, a developing roller 125, and a cartridge case (not illustrated) to accommodate the charging roller 124, the developing roller 125 and the image carrier 121. The development cartridges 120 may include four development cartridges to store CMYK (C: cyan, M: magenta, Y: yellow and K: black) toners (developers), respectively. The number of development cartridges 120 may be varied as necessary. For example, a monochromatic image forming apparatus may include one development cartridge 120 to store the black toner and a color image forming apparatus may include three development cartridges to store the CMY toners except the black toner, respectively.

The image carrier 121 can be charged to a surface potential by the charging roller 124, and the exposure unit 170 can expose the surface of the charged image carrier 121 so that an electrostatic latent image corresponding to a desired image can be formed on the surface. The developing roller 125 can develop the electrostatic latent image with a color toner stored in the development cartridge 120 so that a visible image of the color toner can be formed on the surface of the image carrier 121.

The visible image formed on the surface of the image carrier 121 can be transferred onto the transferred unit 130 so that the visible image can be formed on the surface of the transferred unit 130. For example, the visible image can be transferred onto a surface of an intermediate transfer belt 133 of the transferred unit 130.

The transferred unit 130 can include the intermediate transfer belt 133, a pair of intermediate transfer belt driving rollers 131, intermediate transfer rollers 135 and an idle roller 137. In this example, the idle roller 137 may be omitted.

The intermediate transfer rollers 135 can transfer the visible image formed on the image carriers 121, which face the intermediate transfer roller 135 with the intermediate transfer belt 133 placed therebetween, onto the intermediate transfer belt 133.

The visible image can have certain color, for example, cyan color. While the intermediate transfer belt 133 on which the visible image of the cyan color passes through the next development cartridge 120 and the next intermediate transfer roller 135, the visible cyan color image can be overlaid with a visible image of a different color, for example, yellow color. In this manner, while passing through two remaining development cartridges, the visible cyan and yellow color image on the intermediate transfer belt 133 can be overlaid with visible images of a remaining different color, for example, magenta and/or black color. As a result, a full color visible image can be formed on the intermediate transfer belt 133.

The formed full color image can be transferred onto a print medium, which passes between the transferred unit 130 and the transferring unit 140, by means of the transferring unit 140. Here, a print medium may also be referred to as a transferred medium.

The print medium can be loaded on a paper feed cassette 110, picked up by a pickup roller 111, and then conveyed to a registration roller 166 by means of conveying rollers 113 and 115. The registration roller 166 can register a leading end of the conveyed print medium and then can convey the registered print medium to a transfer nip N, which will be described later with reference to FIG. 5, so that the full color visible image can be transferred onto an image region of the conveyed print medium. Here, the transfer nip N may also be referred to as a transfer region. The transfer region may not be necessarily configured in the form of nips engaging with each other, such as the transfer nip N, but may be configured in other known or later developed shapes to perform toner transfer.

Figure 5:
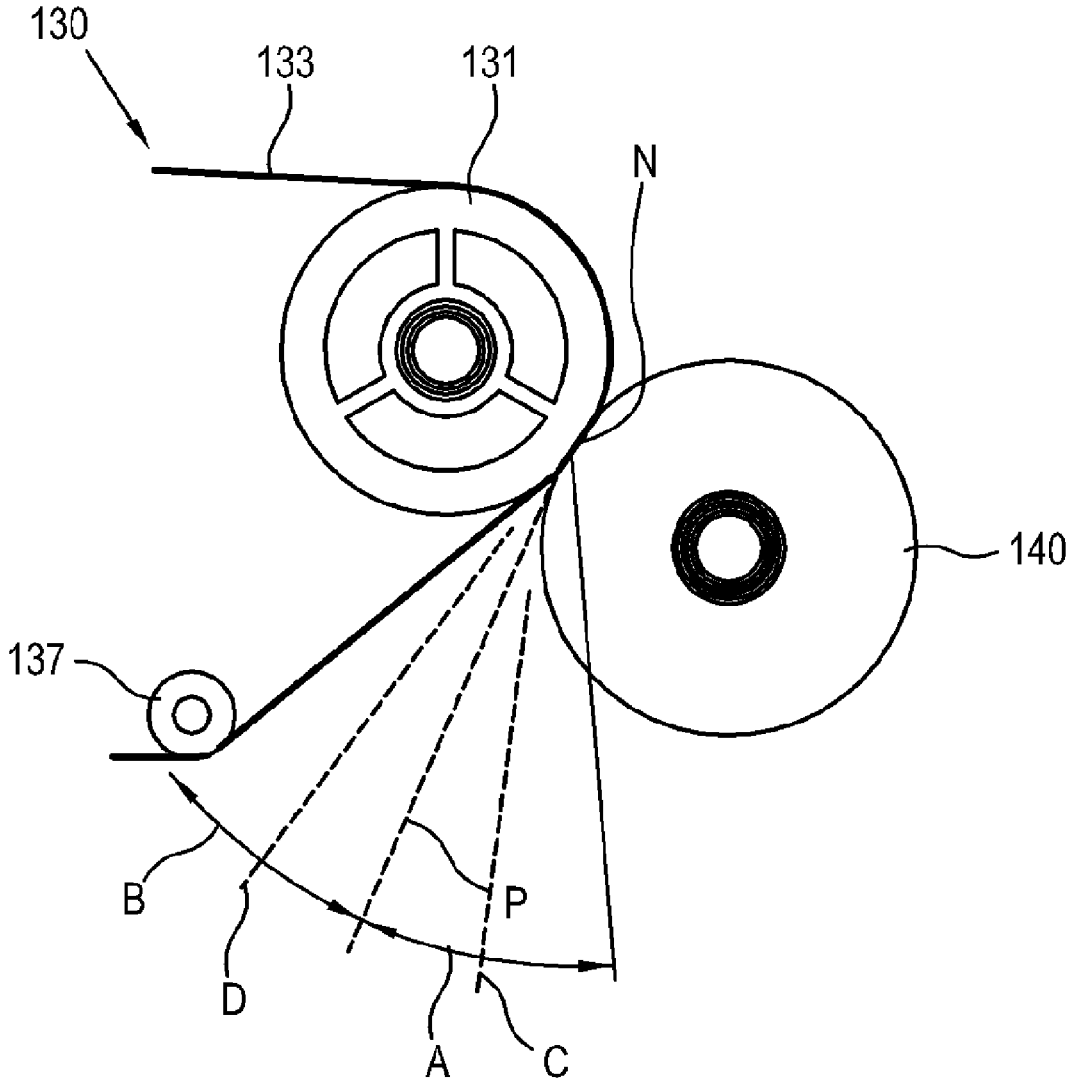
FIG. 5 is an enlarged view illustrating a main part of the image forming apparatus of FIG. 3.

The transferring unit 140 and the transferred unit 130 can form the transfer nip N together, as shown in FIG. 5, and a transfer of the visible image onto the print medium can be conducted in the transfer nip N.

The bias supplying unit 185 can apply a transfer bias to the transferring unit 140. Here, the transfer bias may be at least one of a transfer voltage and a transfer current.

While at least first to third regions of the print medium pass through the transfer nip N, the controller 190 can control the bias supplying unit 185 to supply the transferring unit 140 with a plurality of different biases, for example, different first, second and third transfer bias, as described herein.

For purposes of describing example embodiments of the present general inventive concept, the first to third bias may be different in magnitude if it is of a DC bias, or may be different in at least one of magnitude and frequency if it is of an AC bias.

Also, the at least first to third regions can be divided based on whether an entrance angle of the print medium into the transfer nip N is changed or a transfer electric field is changed when the print medium corresponding to the first to third regions passes through the transfer nip N. Here, the change of the entrance angle of the regions into the transfer nip N can result in a local change of a posture or a convey path of the print medium.

The first to third transfer bias may also be varied depending on at least one of ambient temperature/humidity, thickness of the print medium and lifetime of the transferring unit 140.

In a case where the print medium is designed to pass through the transfer nip N along a normal path P, various attributes of the print medium passing through the transfer nip N may be changed. For example, one region of the print medium may pass through the transfer nip N along an over-transfer path C in a region A near the transferring unit 140 from the normal path P. In this manner, when the print medium passes through the region A near the transferring unit 140, the print medium may be rapidly charged by bias, that is, by a high transfer voltage applied to the transferring unit 140. In other words an excessive transfer electric field can result from the posture change of one region of the print medium (for example, the change of the entrance angle of the print medium into the transfer nip N). Accordingly, after the toners on the intermediate transfer belt 133 of the transferred unit 130 are transferred onto the print medium, the polarity of the toners may be reversed due to the rapid charging of the print medium. Such toners with the reversed polarity on the print medium may be reversely transferred onto the intermediate transfer belt 133 by an electric repulsive force, which may result in an image picking effect of the print medium.

On the other hand, if one region of the print medium passes through the transfer nip N along an under-transfer path D in a region B near the transferred unit 130 from the normal path P, the print medium may be slowly charged, and thus the toners on the intermediate transfer belt 133 may not be fully transferred onto the print medium because of insufficiency of a transfer electric field. Accordingly, an image omission may be observed in one region of the print medium by naked eyes.

Figure 6:
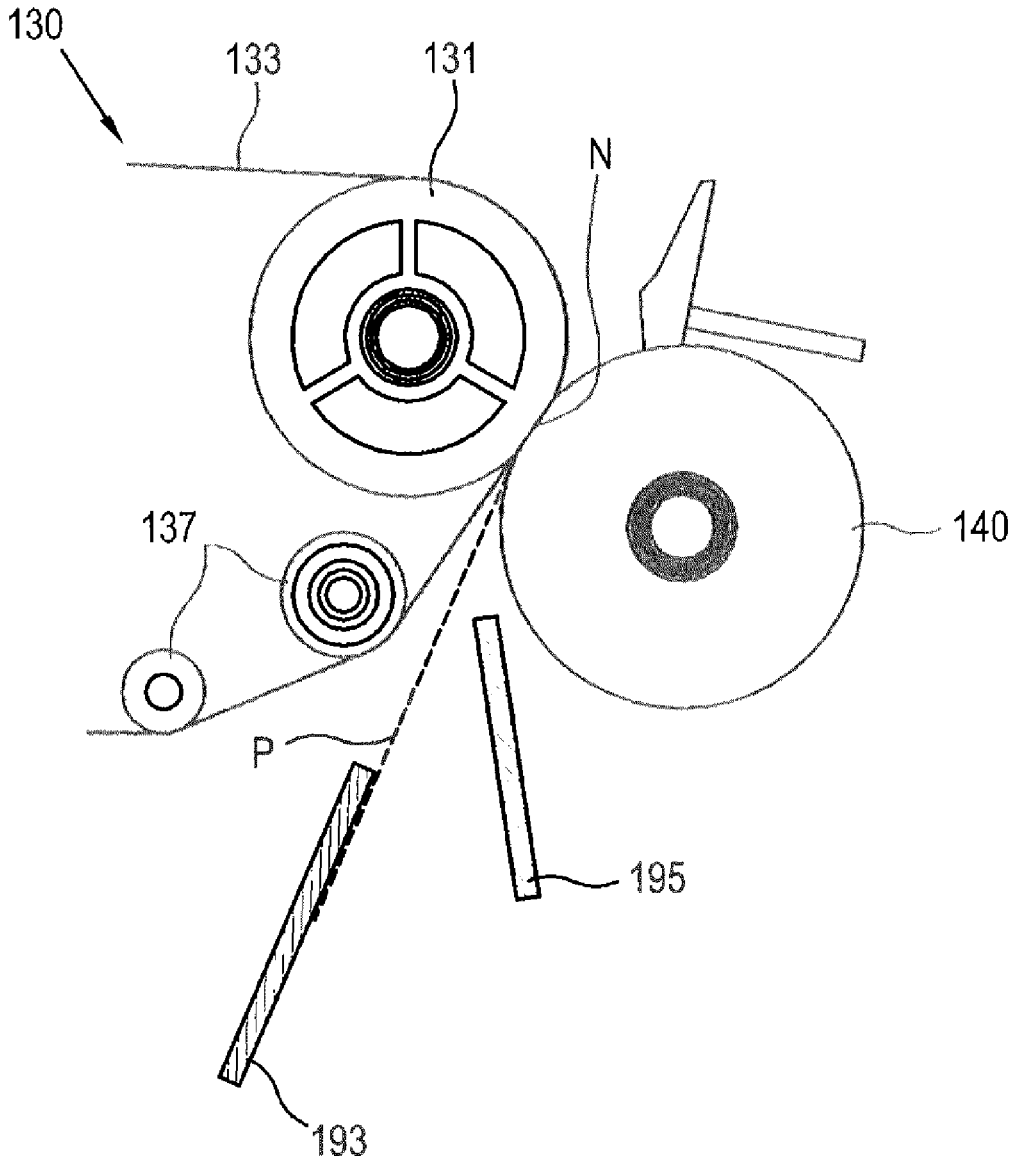
FIG. 6 is a view illustrating a guide plate to guide a transferred unit and a transferring unit to a print medium.

FIG. 6 illustrates guide plates 193 and 195 to guide a print medium to reduce a degree of change of an entrance angle of the print medium into the transfer nip N. With such arrangement of the guide plates 193 and 195, entrance angles of a leading end region, a middle region and a tail end region of the print medium may be changed.

In addition, since the arranged guide plates 193 and 195 may be isolated from the transfer nip N, it may not be possible to guide all regions including the leading end to tail end regions to the transfer nip N, and a posture of the print medium may be inevitably changed.

In addition, as described previously, such change of the posture of the print medium may be caused by combinations of various factors such as a difference in rotation speed between rollers, a difference in path shape between a single-sided print mode and a double-sided print mode, ambient condition such as temperature/humidity, rigidity (thickness) of the print medium, a print speed (ppm) of the image forming apparatus 100, and so on.

Figure 7:
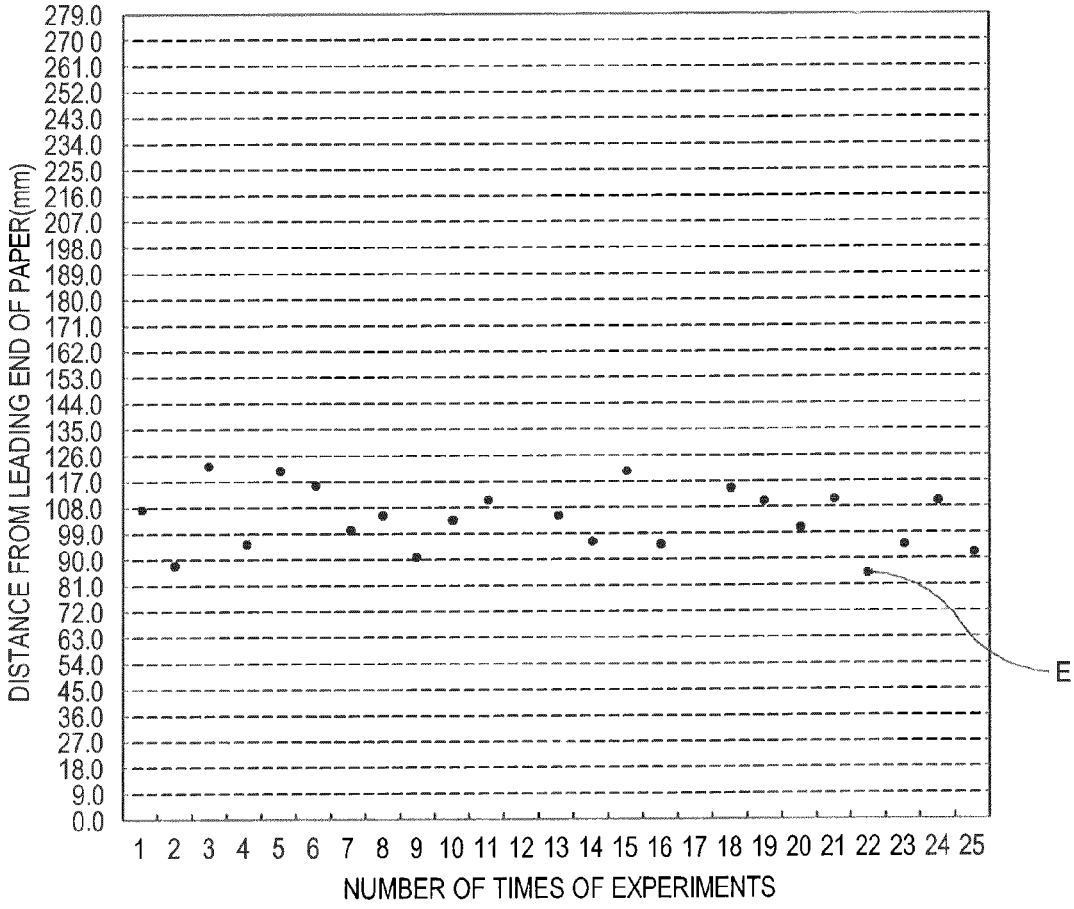
FIG. 7 is a view illustrating a result of a test to measure positions of lack of image in a thin print medium.

FIG. 7 illustrates a result of 25 exemplary print tests performed for thin letter-size print medium (60 [g/m$^3$] of basis weight) with a process speed (252.045 mm/sec) by the image forming apparatus. In these example tests, a constant transfer voltage was applied to the transferring unit 140 while the print medium was being passed through the transfer nip N.

In FIG. 7, the vertical axis represents a distance from a physical leading end of the print medium along a travel direction of the print medium and the horizontal axis represents the number of times of tests. Dots plotted in FIG. 7 represent start points E at which image omission is identified by naked eyes.

In FIG. 7, first and second tests illustrate that an image is omitted in the print medium at positions apart by 108 mm and 81 mm from leading ends of the print medium, respectively. Third to 25$^{th}$ tests illustrate that image omission begins to be identified by naked eyes in a range of about 81 mm to 126 mm from a leading end of the print medium.

Referring to FIG. 7, it can be determined that, while good image quality can be obtained with no image omission within a distance of about 81 mm from the leading end of the print medium, image omission of 85% can occur in a range of about 90 mm to about 126 mm from the leading end. In addition, image omission of 100% can occur from a distance exceeding about 126 mm from the leading end.

Figure 8:
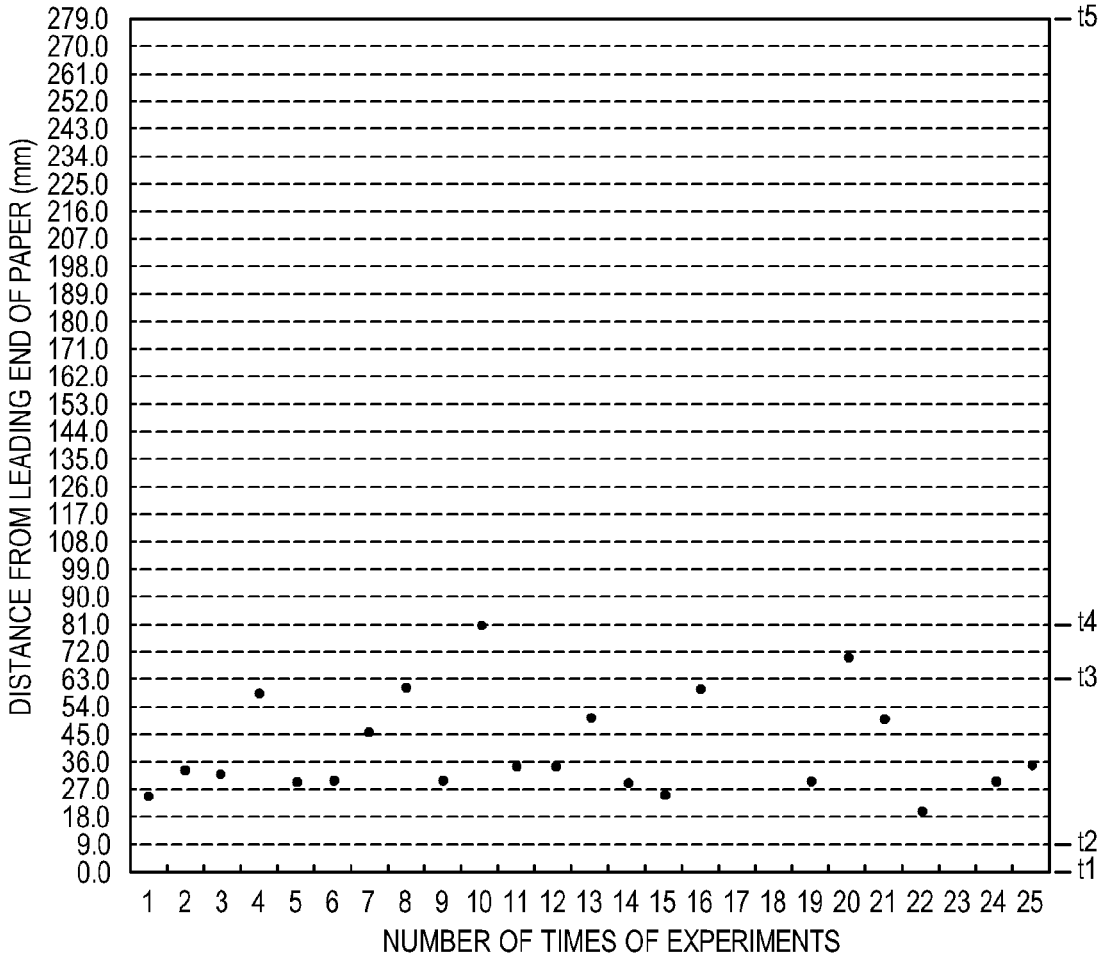
FIG. 8 is a view illustrating a result of the test when a transfer voltage is raised to correct lack of image in FIG. 7.

Since the image omission illustrated in FIG. 7 can be caused by insufficiency of an electric field due to the local change of the entrance angle of the print medium into the transfer nip N, as described above, tests were performed using an increase of a transfer voltage applied to the transferring unit 140 to supplement the insufficient transfer electric field FIG. 8 illustrates a result of these tests.

As illustrated in FIG. 8, an image picking effect of 100% can occur in a range of a leading end of the print medium to about 9 mm and an image picking effect of 85% or so can occur in a range of about 9 mm to about 63 mm. Good image quality can be obtained in a range of the leading end to a distance exceeding about 81 mm with no image picking effect.

Based on the test results of FIGS. 7 and 8, it can be determined that an increase/decrease of the transfer voltage may not properly cope with an image defect (image omission or image picking) due to the change of posture of the print medium.

Figure 9:
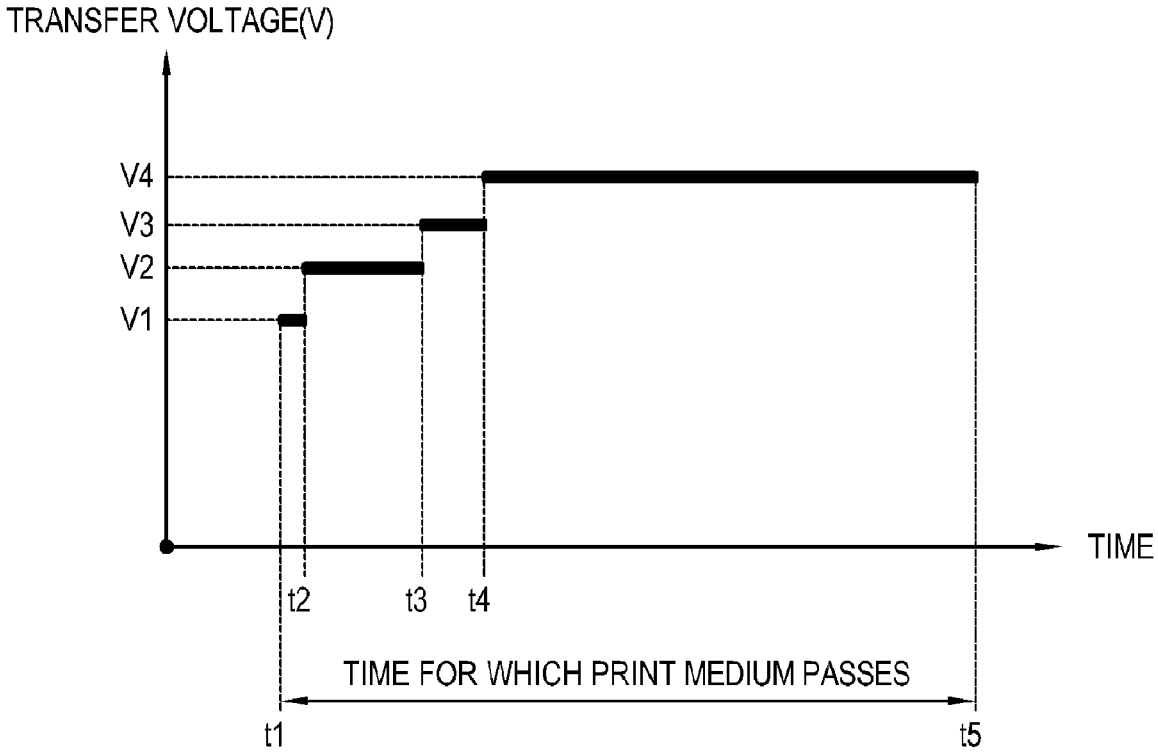
FIG. 9 is an exemplary timing diagram of a transfer voltage to allow removal of the image defect illustrated in FIGS. 7 and 8.

In order to remove an image defect in the test results of FIGS. 7 and 8, the controller 190 of the image forming apparatus 100 may control the bias supplying unit 185 to apply a transfer voltage illustrated in FIG. 9 to the transferring unit 190.

As illustrated in FIG. 8, it is assumed that t1 is a time at which the leading end of the print medium passes through the transfer nip N, t2, t3 and t4 are times at which the print medium distant by 9 mm, 63 mm and 81 mm from the leading end passes through the transfer nip N, respectively, and t5 is a time at which a tail end of the print medium passes through the transfer nip N.

In this case, as illustrated in FIG. 9, in order to remove the image defect, a first transfer voltage V1 can be applied to the transferring unit 140 in an interval of t1 to t2, that is, while the print medium in a range of the leading end to 9 mm passes through the transfer nip N. Next, a second transfer voltage V2 can be applied to the transferring unit 140 in an interval of t2 to t3, that is, while the print medium in a range of 9 mm to 63 mm passes through the transfer nip N. Since a degree of image picking in the range of the leading end to 9 mm is high, an absolute value of the first transfer voltage V1 can be smaller than that of the second transfer voltage V2. That is, the first transfer voltage can be lower than the second transfer voltage.

Next, a third transfer voltage V3 higher than the second transfer voltage V2 can be applied to the transferring unit 140 in an interval of t3 to t4, that is, while the print medium in a range of 63 mm to 81 mm passes through the transfer nip N.

Finally, a fourth transfer voltage V4 higher than the third transfer voltage V3 can be applied to the transferring unit 140 in an interval of t4 to t5, that is, while the print medium in a range of 81 mm to the tail end passes through the transfer nip N. Here, the fourth transfer voltage V4 may be the transfer voltage that provided the good image quality in the range of 81 mm to the tail end in the test of FIG. 8. That is, the transfer voltage timing diagram of FIG. 9 may be derived by reversely lowering a voltage level step by step on the basis of the transfer voltage that provided the good image quality in the test of FIG. 8. More specifically, by applying a transfer voltage which increases stepwise from t1 to t4 to the transferring unit 140, it is possible to remove the image picking effect which occurs in the leading end region of the print medium as illustrated in FIG. 8 and the image omission effect which occurs in the tail end region of the print medium as illustrated in FIG. 7.

In these examples, the leading end region and the tail end region are interpreted to mean that the former precedes the latter with respect to a traveling direction of the print medium, and may not necessarily coincide with physical leading and tail ends of the print medium. For example, the leading end region may correspond to a region covering a range from the physical leading end of the print medium to a point exceeding a physical middle region of the print medium. That is, the size of each region may be varied. The middle region can be interpreted to mean the remaining region except the leading end region and the tail end region.

Figure 10:
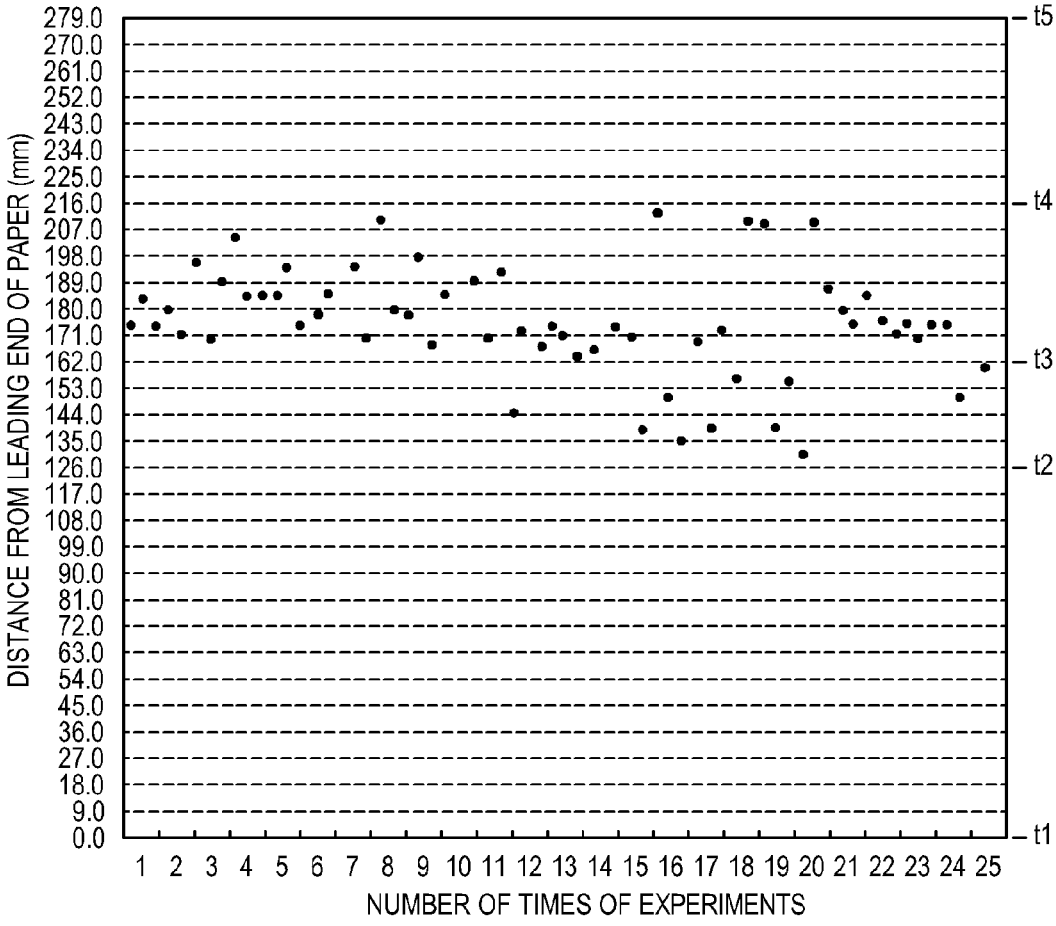
FIG. 10 is a view illustrating a result of a test to measure positions of lack of image in a thick print medium.

FIG. 10 illustrates a result of a test performed using a print medium of a kind different from that of the print medium tested in FIGS. 7 and 8.

In FIG. 10, the print medium used is a thick letter (163 [g/m$^3$] of basis weight) and a process speed is 126.023 [mm/sec]. For a thick print medium, the process speed can be decreased since it generally requires more heat and pressure than a thin print medium in toner fixation. Accordingly, the test of FIG. 10 was performed at a process speed which is about half (126.023 [mm/sec] 25 ppm) as low as that (252.045 [mm/sec]) of FIG. 7.

As illustrated in FIG. 10, while relatively good image quality can be obtained with no image omission within a range of a leading end of the print medium to about 126 mm, image omission of 85% occurs in a range of about 162 mm to about 216 mm from the leading end. In addition, image omission of 100% occurs from a distance exceeding about 216 mm to a tail end of the print medium.

Figure 11:
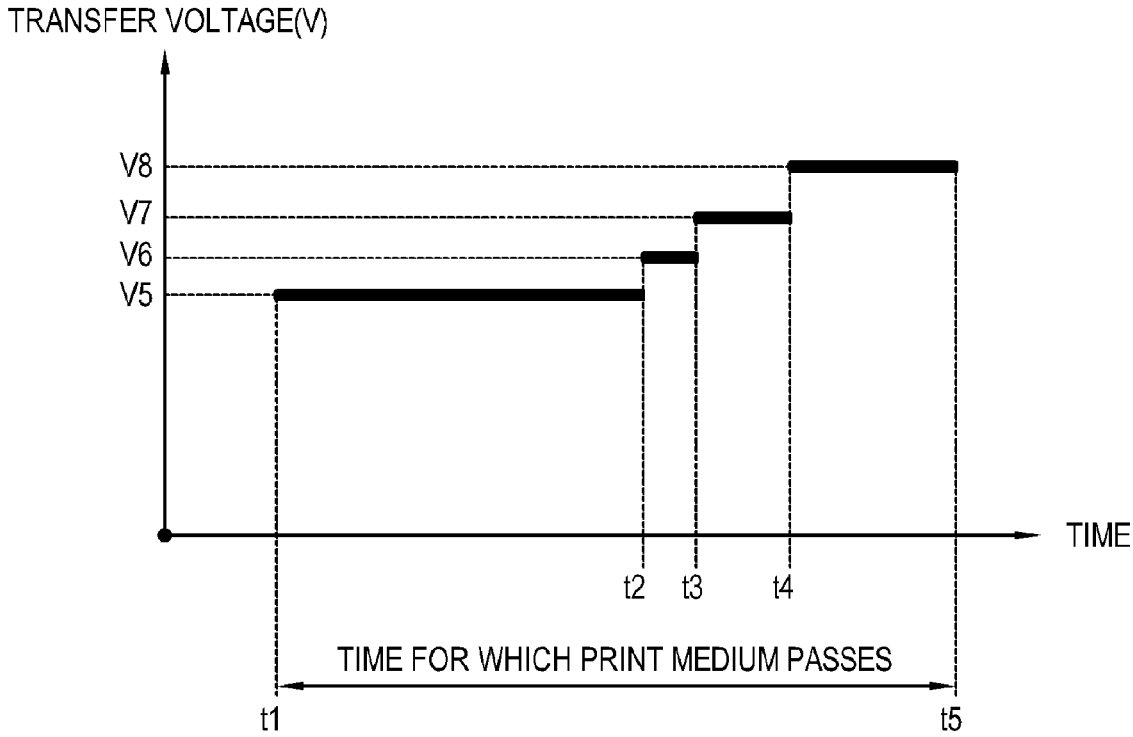
FIG. 11 is an exemplary timing diagram of a transfer voltage to allow removal of the image defect illustrated in FIG. 10.

In order to prevent such an image defect, a transfer voltage having a pattern illustrated in FIG. 11 can be applied to the transferring unit 140.

Since the image omission effect can result from insufficiency of a transfer electric field, which can be caused when the print medium enters the transfer nip N along an under-transfer path in the region (B in FIG. 5) near the transferred unit 130 when passing through the transfer nip N, an absolute value of a transfer voltage to be applied while the region with the image omission passes through the transfer nip N can be adjusted to be larger than that of a transfer voltage to be applied while the region with the good image quality passes through the transfer nip N.

More specifically, as illustrated in FIG. 10, assuming that t1, t2, t3, t4 and t5 are times at which the leading end, 126 mm, 162 mm, 216 mm and the tail end of the print medium pass through the transfer nip N, respectively, a pattern of the transfer voltage illustrated in FIG. 11 can be as follows.

A first transfer voltage V5 can be applied in an interval of t1 to t2, that is, while the region of the leading end of the print medium to 126 mm passes through the transfer nip N. Here, the first transfer voltage V5 may be the transfer voltage used for the tests of FIG. 10.

A second transfer voltage V6 having an absolute value larger than that of the first transfer voltage V5 can be applied to the transferring unit 140 in an interval of t2 to t3, that is, while the region of 126 mm to 162 mm passes through the transfer nip N.

A third transfer voltage V7 having an absolute value larger than that of the second transfer voltage V6 can be applied to the transferring unit 140 in an interval of t3 to t4, that is, while the region of 162 mm to 216 mm passes through the transfer nip N.

A fourth transfer voltage V8 having an absolute value larger than that of the third transfer voltage V7 can be applied to the transferring unit 140 in an interval of t4 to t5, that is, while the region of 216 to the tail end passes through the transfer nip N.

As described above, the print medium may be divided into four regions and different first to fourth transfer voltages may be applied to the transferring units 140 to compensate for an image defect occurring in each of the regions.

Figure 16:
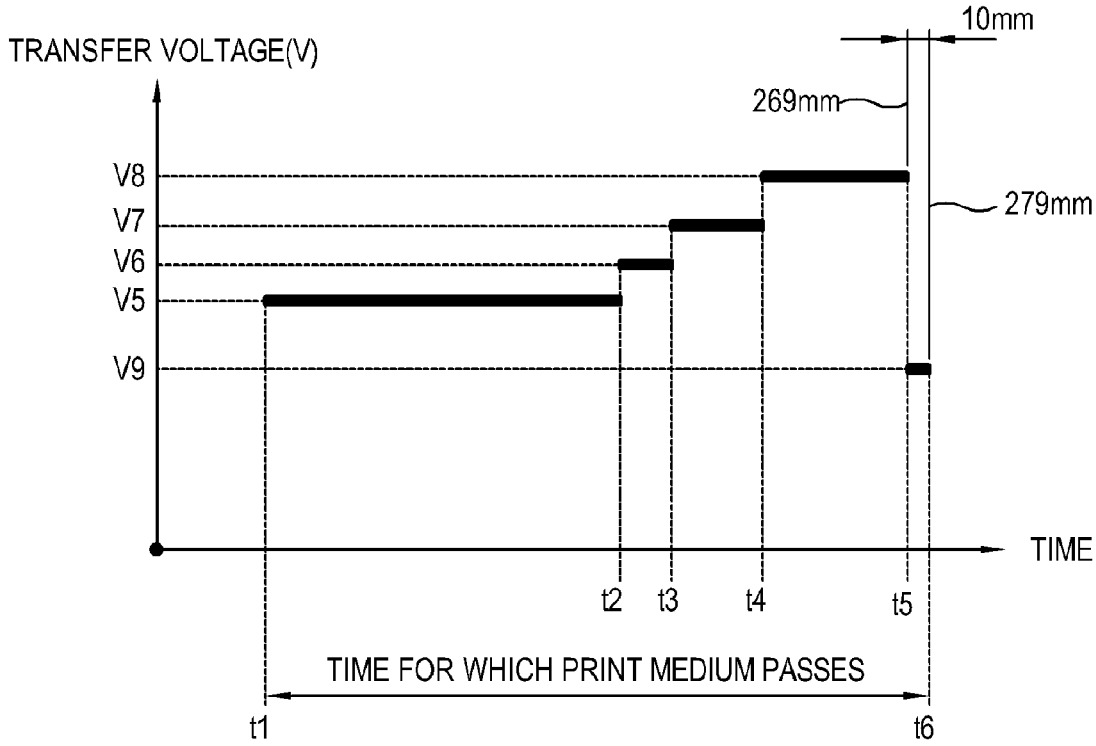
FIG. 16 is another exemplary timing diagram of the transfer voltage of FIG. 11.

FIG. 16 illustrates a modification of the transfer voltage timing diagram illustrated in FIG. 11.

For a thick print medium having high rigidity, at a moment when its tail end region deviates from the guide plates 193 and 195, a strong electric field can be produced while the tail end region is moving to the transferring unit 140 by elasticity. This may lead to image picking of the tail end region, which may result in deterioration of image quality. Accordingly, while the region from 269 mm, which is about 10 mm ahead from the tail end in FIG. 10, to the tail end (279 mm) is passing through the transfer nip N, the controller 180 may control the bias supplying unit 185 to apply a fifth transfer voltage V9 having an absolute value lower than that of the first transfer voltage V5 to the transferring unit 140 between the time t5 and a time t6 at which the end of the print medium passes the transfer nip N.

Generalizing the tests of FIGS. 10 and 11, if the thickness of the print medium exceeds a predetermined thickness and its convey speed exceeds a predetermined speed, while the leading end region, the middle region and the tail end region of the print medium pass through the transfer nip N, the controller 190 may control the bias supplying unit 185 to apply a first transfer bias, a second transfer bias having an absolute value larger than that of the first transfer bias, and a third transfer bias having an absolute value larger than that of the second transfer bias to the transferring unit 140, respectively. Here, the predetermined thickness may be about 90 [g/m$^3$] of basis weight and the predetermined speed may be about 12 ppm. Here, the predetermined thickness and the predetermined speed may be varied depending on formation of print convey paths, roller arrangement, ambient temperature/humidity, lifetime (use time) of the transferring unit 140 and so on in the image forming apparatus.

Figure 12:
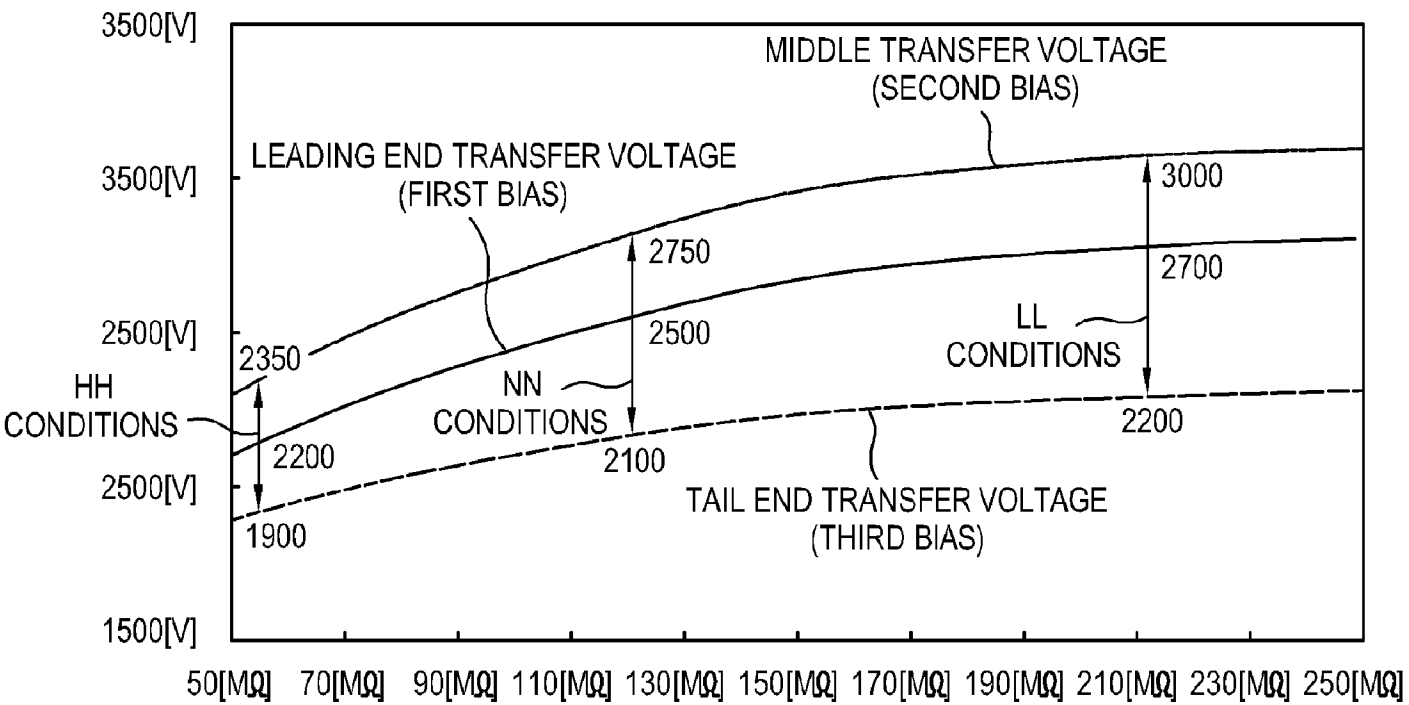
FIG. 12 is a view illustrating a pattern of a transfer voltage to be applied to a leading end, a middle portion and a tail end of a print medium depending on system resistance of a thick print medium.

FIG. 12 illustrates a graph of a transfer voltage to be applied to a leading end region, a middle region and a tail end region of a print medium depending on system resistance. In FIG. 12, in consideration that a posture of the print medium can worsen at a point of time when the leading end region of the print medium passes through the transfer nip N and at a point of time when the tail end region of the print medium secedes from the transfer nip N, the leading end region may be assumed to correspond to a region from the leading end of the print medium to a distance of about 10 mm to about 20 mm and the tail end region may be assumed to correspond to a region from the tail end of the print medium to a distance of about 10 mm to about 20 mm. The leading and tail end regions are not necessarily limited to these regions but may be varied depending on the presence or absence of the guide plates 193 and 195, their arrangement angle and length and/or other design characteristics of the print medium and transfer mechanisms.

In this example, the print medium is thick paper of about 163 [g/m$^3$] of basis weight and the convey speed of the print medium is about 5 ppm (24.75 mm/sec) which corresponds to only 20% of the convey speed (126 mm/sec) of the print medium in FIGS. 10 and 11. If the print medium is thick and its convey speed is low, a leading end transfer voltage (the first transfer bias), the middle transfer voltage (the second transfer bias) and the tail end transfer voltage (the third transfer bias) may be applied to the transferring unit 140 while the leading end region, the middle region and the tail end region of the print medium pass through the transfer nip N, respectively, as illustrated in FIG. 12.

In this case, an absolute value of the middle transfer voltage (the second transfer bias) can be larger than that of the leading end transfer voltage (the first transfer bias) and an absolute value of the tail end transfer voltage (the third transfer bias) can be smaller than that of the leading end transfer voltage (the first transfer bias).

The controller 190 can sense system resistance by applying a sensing voltage or current to the transferring unit 140 before the leading end of the print medium passes through the transfer nip N. The system resistance can correspond to a value reflected by an effect by ambient temperature/humidity and the lifetime of the transferring unit 140. The lower the ambient temperature/humidity, the higher the system resistance tends to be.

Accordingly, under low ambient temperature (for example, 10° C. or below) and humidity (for example, 30% or below) conditions (referred to herein as "LL conditions"), transfer voltages of 2700 V, 3000 V and 2200 V can be applied to the transferring unit 140 while the leading end region, the middle region and the tail end region of the print medium pass through the transfer nip N, respectively. In other words, the absolute value of the middle transfer voltage (the second transfer bias) can be larger than that of the leading end transfer voltage (the first transfer bias) and the absolute value of the tail end transfer voltage (the third transfer bias) can be smaller than that of the leading end transfer voltage (the first transfer bias).

Here, a range classified into HH, NN and LL conditions depending on the ambient temperature/humidity does not have a constant value but may be varied as necessary.

Under normal ambient temperature/humidity conditions (referred to herein as "NN conditions"), transfer voltages of 2500 V, 2750 V and 2100 V can be applied to the transferring unit 140, respectively. Under high ambient temperature (for example, 30° C. or above) and humidity (for example, 80% or above) conditions (referred to herein as "HH conditions"), transfer voltages of 2200 V, 2350 V and 1900 V can be applied to the transferring unit 140, respectively.

As illustrated in FIG. 12, as the ambient temperature/humidity becomes lower, a difference between the leading end transfer voltage (the first transfer bias) and the middle transfer voltage (the second transfer bias) and a difference between the leading end transfer voltage (the first transfer bias) and the tail end transfer voltage (the third transfer bias) can become increased.

Referring to FIG. 12, it can be determined that if the thickness of the print medium exceeds a predetermined thickness and its convey speed exceeds a predetermined speed, while the leading end region, the middle region and the tail end region of the print medium pass through the transfer nip N, the controller 190 may control the bias supplying unit 185 to apply the first transfer bias, the second transfer bias having an absolute value larger than that of the first transfer bias, and the third transfer bias having an absolute value smaller than that of the first transfer bias to the transferring unit 140, respectively. In this example, the predetermined thickness may be about 90 [g/m$^3$] of basis weight and the predetermined speed may be about 12 ppm. Here, the predetermined thickness and the predetermined speed may be varied depending on formation of print convey paths, roller arrangement, ambient temperature/humidity, lifetime (use time) of the transferring unit 140 and/or other design characteristics of the image forming apparatus.

Figure 13:
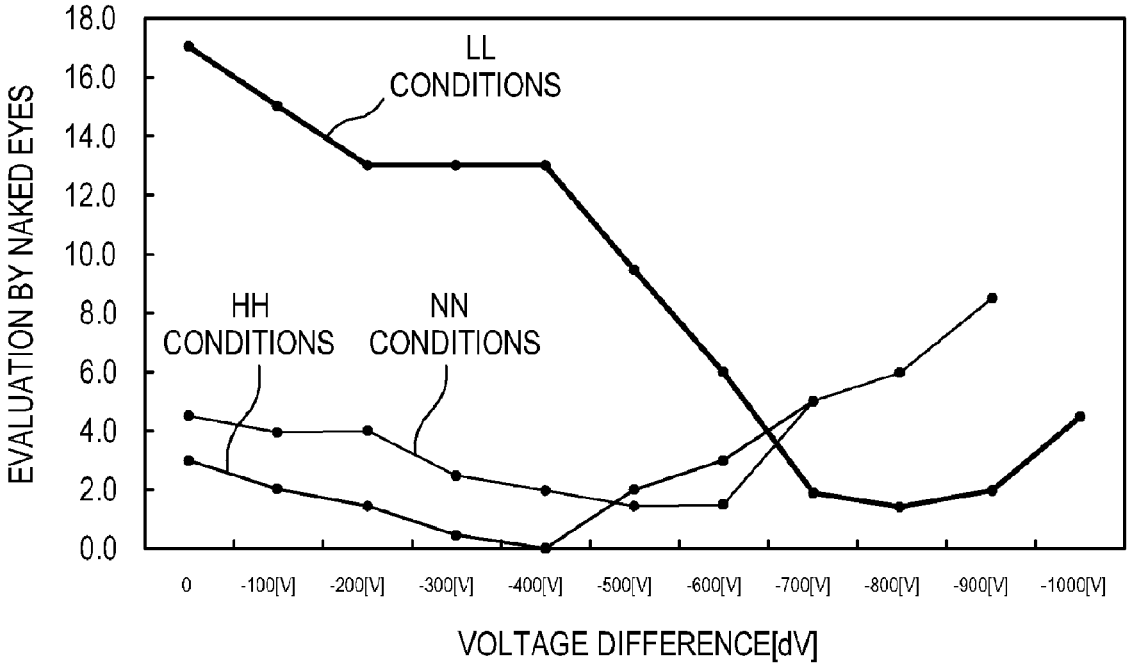
FIG. 13 is a view illustrating a result of a test when another transfer voltage is applied to a tail end of a print medium depending on change of ambient temperature/humidity.

FIG. 13 is a graph to evaluate whether an image defect or an image concentration difference can be identified in the tail end region of the same kind of print medium by naked eyes when a tail end transfer voltage lower by a voltage difference (dV) than a middle transfer voltage applied while the middle region of the print medium passes through the transfer nip N is applied while the tail end region of the print medium passes through the transfer nip N. In the graph of FIG. 13, a smaller numerical value of evaluation by naked eyes on a vertical axis can be interpreted to mean better improvement of image quality while the horizontal axis represents the voltage difference (dV).

As illustrated in FIG. 13, if the voltage difference is −400 V under HH conditions, that is, if a tail end transfer voltage lower by about 400 V than a middle transfer voltage is applied, the optimum image quality can be achieved, and, if the tail end transfer voltage lower by about 600 V than the middle transfer voltage is applied under NN conditions, the optimum image quality can be achieved. In addition, if the tail end transfer voltage lower by about 900 V than the middle transfer voltage is applied under LL conditions, the optimum image quality can be achieved. It can be also seen that the voltage difference (dV) is made larger as the ambient temperature/humidity becomes lower.

Figure 14:
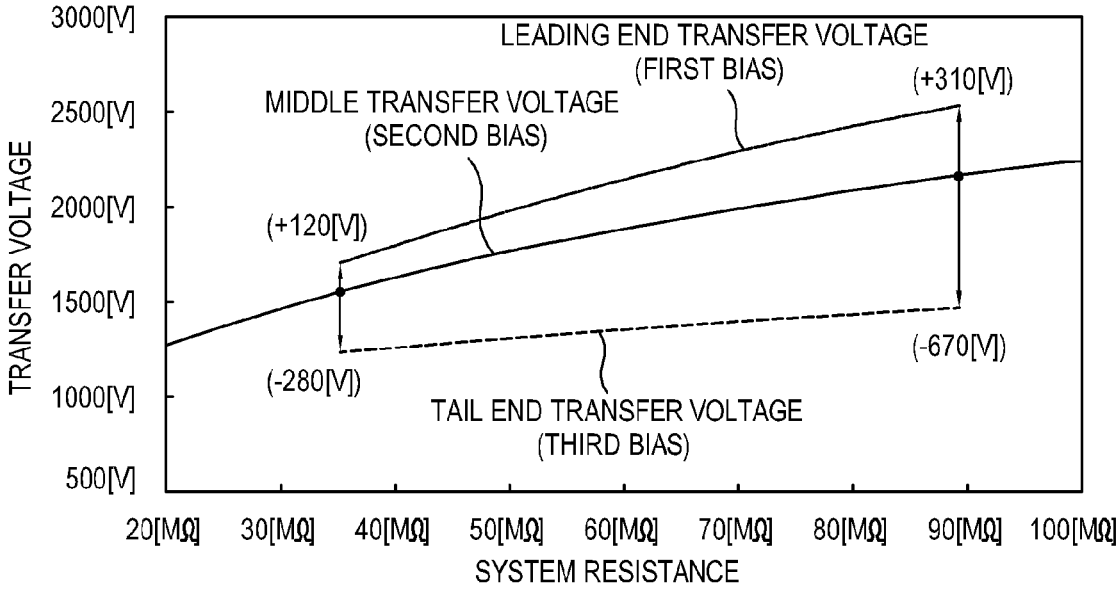
FIG. 14 is an exemplary view illustrating a pattern of a transfer voltage to be applied to a transferring unit while a leading end, a middle portion and a tail end of a general print medium pass through a transfer region, depending on system resistance under conditions of normal temperature and normal humidity.

FIG. 14 illustrates a pattern of a transfer voltage to be applied to the transferring unit 140 depending on system resistance for a print medium having typical thickness (60 to 90 [g/m$^3$] of basis weight). In a general print mode, the transferring unit 140 can be an initial article (use time being zero), and the ambient temperature and humidity can be normal temperature and normal humidity (NN conditions), respectively.

When the leading end region, the middle region and the tail end region of the print medium pass through the transfer nip N, the controller 190 can control the bias supplying unit 185 to apply the leading end transfer voltage (the first transfer bias), the middle transfer voltage (the second transfer bias) and the tail end transfer voltage (the third transfer bias) to the transferring unit 140, respectively.

In this example, the absolute value of the middle transfer voltage (the second transfer bias) can be smaller than that of the leading end transfer voltage (the first transfer bias) and the absolute value of the tail end transfer voltage (the third transfer bias) can be smaller than that of the middle transfer voltage (the second transfer bias).

Figure 15:
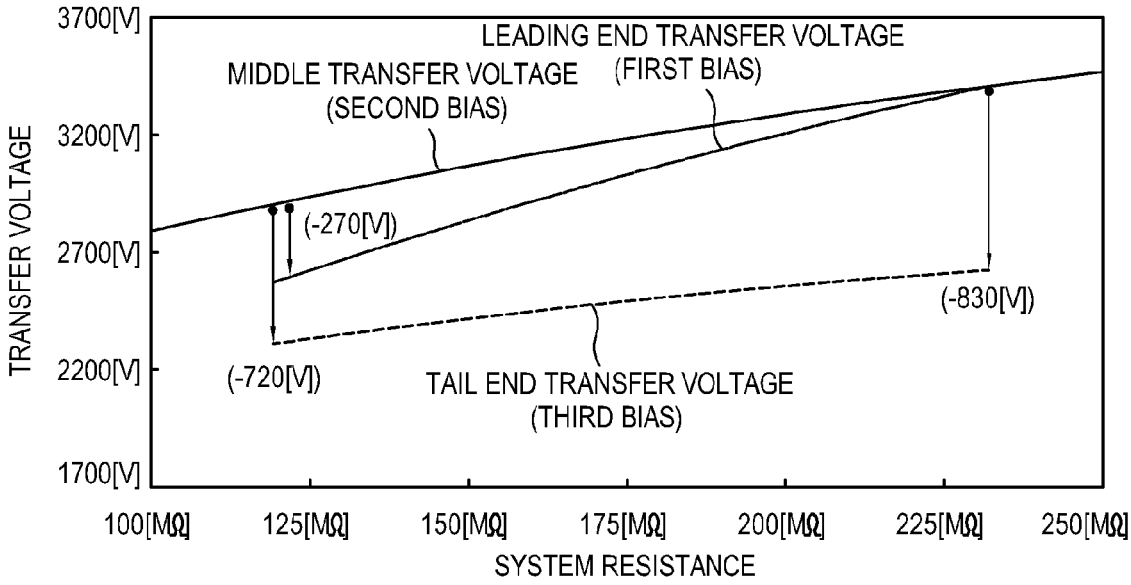
FIG. 15 is an exemplary view illustrating a pattern of a transfer voltage to be applied to a transferring unit while a leading end, a middle portion and a tail end of a general print medium pass through a transfer region, depending on system resistance under conditions of low temperature and low humidity.

FIG. 15 illustrates a pattern of transfer voltage to be applied to the transferring unit 140 in a case where the general paper is printed in a single-sided print mode under low-temperature and low-humidity conditions (LL conditions). The transferring unit 140 can be an initial article.

When the leading end region, the middle region and the tail end region of the print medium pass through the transfer nip N, the controller 190 can control the bias supplying unit 185 to apply the leading end transfer voltage (the first transfer bias), the middle transfer voltage (the second transfer bias) having an absolute value larger than that of the leading end transfer voltage (the first transfer bias), and the tail end transfer voltage (the third transfer bias) having an absolute value smaller than that of the leading end transfer voltage (the first transfer bias) to the transferring unit 140, respectively.

As the ambient temperature and humidity becomes lower, the system resistance becomes larger. As illustrated in FIG. 15, as the system resistance becomes larger, a variation of the leading end transfer voltage (the first transfer bias) become larger than those of the middle transfer voltage (the second transfer bias) and the tail end transfer voltage (the third transfer bias).

In the meantime, as illustrated in FIG. 4, the image forming apparatus 100 according to an example embodiment of the present general inventive concept may further include an interface unit 181 connected to a host device such as an external computer, a display unit 182 to display predetermined information to a user, an input unit 183 to receive an input from the user, and a driving unit 184 controlled by the controller 190 to rotate/drive various rollers in the image forming apparatus 100 of FIG. 3. The user interface unit 181, display unit 182, and input unit 183 can be integrated with the controller 190, or can be provided separately in various combinations.

Figure 17A:
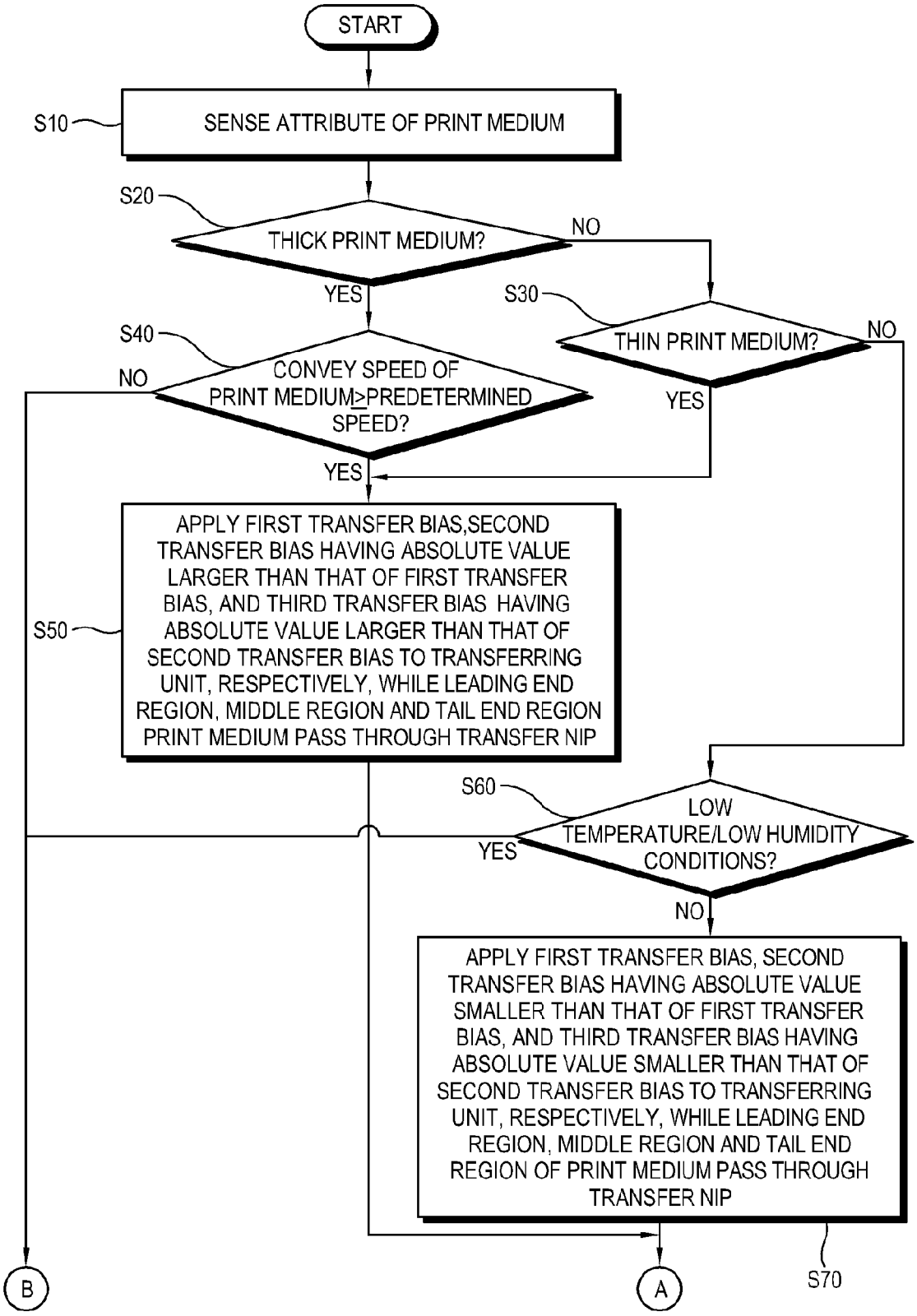
FIGS. 17A and 17B are flow charts of a control method of an image forming apparatus according to an embodiment of the present general inventive concept.
Figure 17B:
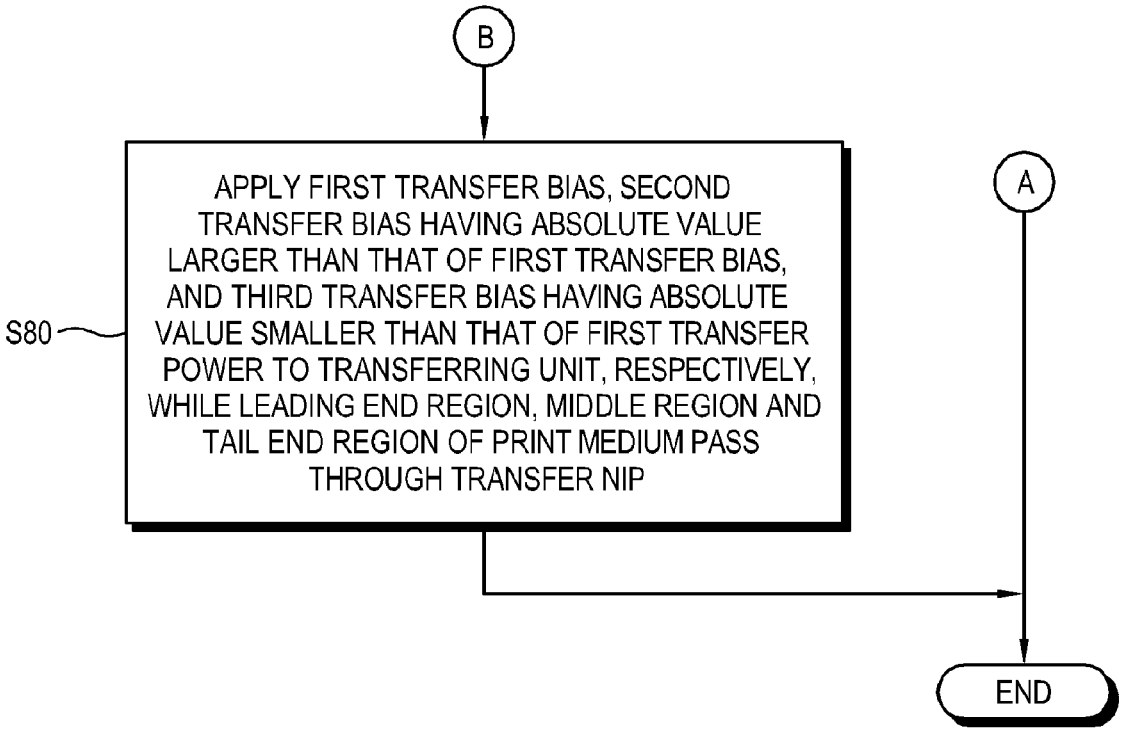

Hereinafter, a control method of the image forming apparatus of the present general inventive concept will be described with reference to FIGS. 17A and 17B.

In a control method of the image forming apparatus according to an embodiment of the present general inventive concept, an attribute of the print medium can be sensed as illustrated in FIGS. 3, 5, 17A and 17B.

When first to third regions of the print medium pass through the transfer nip N according to the sensed attribute of the print medium, different first to third biases can be applied to the transferring unit, respectively. In operation S10, an attribute may be sensed, such as a thickness of a print medium and a temperature or humidity level.

To apply the first to third biases, it can be determined whether thickness of the print medium exceeds a first predetermined value (S20). Here, the first predetermined value may be about 90 [g/m$^3$] of basis weight and may be properly varied as necessary. The print medium may be set as a thick print medium, a general print medium and a thin print medium depending on a manufacturer of the image forming apparatus.

If it is determined that the thickness of the print medium exceeds the first predetermined value (YES in S20), it can be determined whether a convey speed of the print medium exceeds a predetermined speed, at operation S40. Here, the predetermined speed may be about 12 ppm. The predetermined speed can be used to determine whether the convey speed of the print medium, that is, a process speed, is low or high, and thus it is to be understood that the predetermined speed may be set to be a different value other than the specified value.

If it is determined whether the convey speed of the print medium exceeds the predetermined speed (YES in S40), the first transfer bias, the second transfer bias having an absolute value larger than that of the first transfer bias, and the third transfer bias having an absolute value larger than that of the second transfer bias can be applied to the transferring unit, respectively, while the leading end region, the middle region and the tail end region of the print medium pass through the transfer nip, at operation S50.

If it is determined that the convey speed is lower than the predetermined speed (NO in S40), the first transfer bias, the second transfer bias having an absolute value larger than that of the first transfer bias, and the third transfer bias having an absolute value smaller than that of the first transfer bias can be applied to the transferring unit, respectively, while the leading end region, the middle region and the tail end region of the print medium pass through the transfer nip, at operation S80.

If it is determined that the thickness of the print medium is smaller than the first predetermined value (NO in S20), it can be determined whether the print medium is thin, at operation S30. That is, it can be determined whether the thickness of the print medium is smaller than a second predetermined value. In this case, the second predetermined value may be about 60 [g/m$^3$] of basis weight and may be varied depending on a manufacturer of the image forming apparatus.

If it is determined that the thickness of the print medium is smaller than the second predetermined value (YES in S30), the first transfer bias, the second transfer bias having an absolute value larger than that of the first transfer bias, and the third transfer bias having an absolute value larger than that of the second transfer bias can be applied to the transferring unit, respectively, while the leading end region, the middle region and the tail end region of the print medium pass through the transfer nip, at operation S50.

If it is determined that the thickness of the print medium is not smaller than the second predetermined value (NO in S30), that is, if the print medium is a print medium having general thickness, it can be determined whether ambient environments are under low temperature/low humidity conditions (LL conditions), at operation S60. This can be indirectly known from the above-mentioned system resistance and may be directly known from a temperature sensor and a humidity sensor separately provided in the image forming apparatus 100, for example.

If it is determined that the ambient environments are under low temperature/low humidity conditions (LL conditions) (YES in S60), the first transfer bias, the second transfer bias having an absolute value larger than that of the first transfer bias, and the third transfer bias having an absolute value smaller than that of the first transfer bias can be applied to the transferring unit, respectively, while the leading end region, the middle region and the tail end region of the print medium pass through the transfer nip, at operation S80.

If it is determined that the ambient environments are not under low temperature/low humidity conditions (NO in S60), the first transfer bias, the second transfer bias having an absolute value smaller than that of the first transfer bias, and the third transfer bias having an absolute value smaller than that of the second transfer bias can be applied to the transferring unit, respectively, while the leading end region, the middle region and the tail end region of the print medium pass through the transfer nip, at operation S70.

In this manner, although a posture of the print medium, that is, an entrance angle of the print medium into the transfer nip N, can be varied depending on the thickness of the print medium, it is possible to prevent image defects (image omission, image picking or change of image concentration) by correspondingly varying the applied electric field.

Figure 18:
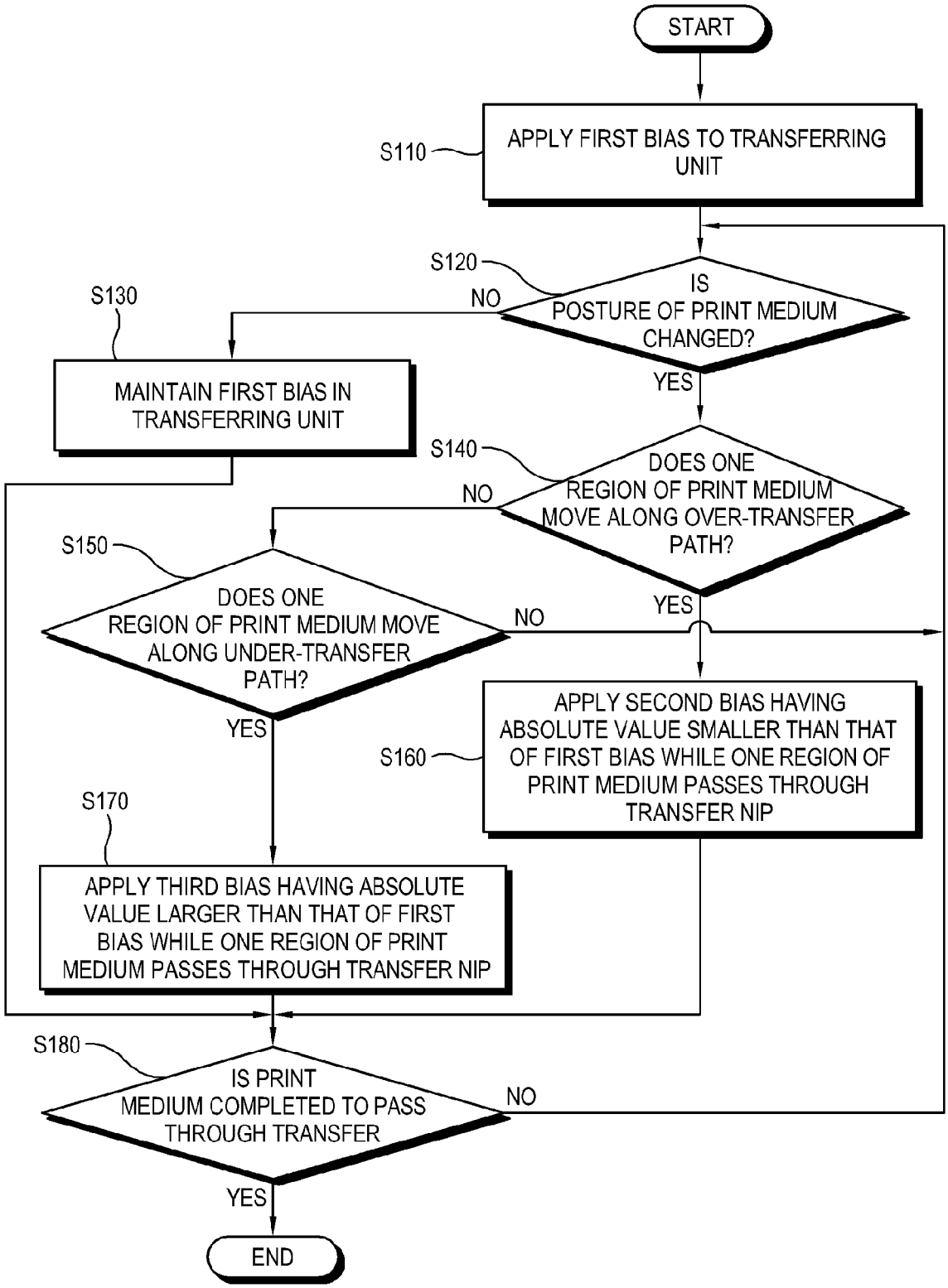
FIG. 18 is a flow chart of a control method of an image forming apparatus according to another embodiment of the present general inventive concept.

A control method of the image forming apparatus according to another embodiment of the present general inventive concept will be described with reference to FIG. 18.

At operation S110, the first transfer bias can be applied to the transferring unit 140.

At operation S120, it can be determined whether a posture of the print medium is changed. Here, the change of posture of the print medium can be interpreted to mean that the print medium deviates from a designed normal path and passes through the transfer nip N along a different path. That is, the change of posture of the print medium can mean a change of the entrance angle of the print medium into the transfer nip N.

Since it is difficult to directly sense the change of posture of the print medium, a point of time when the posture of the print medium is changed may be indirectly predicted by finding at which point from the leading end of the print medium that the posture of the print medium is changed, or at which point of time that the posture of the print medium is changed from time when the leading end passes through the transfer nip through a plurality of experiments. The point or the point of time that the posture of the print medium is changed can be stored in a memory (not illustrated) of the image forming apparatus 100.

If it is determined that the posture of the print medium is not changed (NO in S120), the first transfer bias can continue to be applied to the transferring unit 140, at operation S130.

If it is determined that the posture of the print medium is changed (YES in S120), it can be determined whether one region of the print medium moves along the over-transfer transfer path C, at operation S140. That is, it can be determined whether the change of posture of the print medium is a change of posture of the print medium in the form of accessing to the transferring unit 140 and passing through the transfer nip N.

If it is determined that one region of the print medium moves along the over-transfer transfer path C (YES in S140), the second transfer bias having an absolute value smaller than the first transfer bias can be applied to the transferring unit 140, at operation S160. Accordingly, it is possible to prevent a transfer electric field from being excessively increased due to rapid charging as the one region of the print medium moves along the over-transfer path C, and thus prevent image defects such as image picking.

If not so (NO in S140), it can be determined whether the one region of the print medium moves along the under-transfer path D, at operation S150. If so (YES in S150), the second transfer bias having an absolute value larger than that of the first transfer bias can be applied to the transferring unit 140 while the one region of the print medium passes through the transfer nip N, at operation S170.

If the print medium enters the transfer nip N along the under-transfer path D, a transfer electric field can become insufficient, and accordingly, by applying the stronger second transfer bias to the transferring unit 140 to supplement the insufficient transfer electric field, it is possible to prevent image defects such as image omission.

The operations S120 to S170 can continue to be performed until one page of the print medium completely passes through the transfer nip, at operation S180.

Although the indirect transfer system in which the visible image formed on the image carrier 121 can be transferred onto the transferred unit 130 and then the visible image of the transferred unit 130 can be transferred onto the print medium has been illustrated and described above, the above-described transfer bias application method is not limited thereto, and may be applied to a direct transfer system in which the transferred unit becomes the image carrier itself. More specifically, in a direct transfer system in which the image carrier opposes the transferring unit with the print medium interposed therebetween and the visible image of the image carrier is transferred onto the print medium, the transfer biases may be applied to the transferring unit according to the above-described transfer application method. That is, in the direct transfer system, the transferred unit can correspond to the image carrier.

According to example embodiments of the present general inventive concept, it is possible to improve image quality in consideration of a change of posture of a print medium. In addition, it is possible to reduce image defects or a change of image concentration caused by the change of posture of the print medium.

It is also possible to adjust concentration of an image formed on the print medium. In addition, it is possible to make image concentration uniform and vary the image concentration artificially.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a transferring unit to form a visible image on a transferred medium, the transferring unit having a transfer region at which the visible image is formed;

a bias supplying unit to supply bias to the transferring unit; and a controller to control the bias supplying unit to supply first to third biases to the transferring unit to form the visible image on the transferred medium, wherein the first to third biases respectively correspond to first to third portions of the transferred medium having different entrance angles with respect to the transfer region.

2. The image forming apparatus according to claim 1, wherein the controller controls the bias supplying unit to supply the first to third biases to the transferring unit while the at least first to third regions of the transferred medium pass the transfer region.

3. The image forming apparatus according to claim 2, wherein the at least first to third regions of the transferred medium are divided based on whether the entrance angle of the print medium into the transfer region and a transfer electric field are changed while the transferred medium passes through the transfer region.

4. The image forming apparatus according to claim 2, wherein the first to third regions respectively correspond to a leading end region, a middle region, and a tail end region of the transferred medium on the basis of a travel direction of the transferred medium, and wherein an absolute value of the second bias is larger than an absolute value of the first bias and an absolute value of the third bias is smaller than the absolute value of the first bias.

5. The image forming apparatus according to claim 2, wherein the first to third regions respectively correspond to a leading end region, a middle region, and a tail end region of the transferred medium on the basis of a travel direction of the transferred medium, and wherein an absolute value of the second bias is larger than an absolute value of the first bias and an absolute value of the third bias is larger than the absolute value of the second bias.

6. The image forming apparatus according to claim 2, wherein the first to third regions respectively correspond to a leading end region, a middle region, and a tail end region of the transferred medium on the basis of a travel direction of the transferred medium, and wherein an absolute value of the second bias is smaller than an absolute value of the first bias and an absolute value of the third bias is smaller than the absolute value of the second bias.

7. The image forming apparatus according to claim 1, wherein the first to third biases are varied depending on at least one of ambient temperature/humidity, thickness of the transferred medium, use time of the transferring unit, and a print mode of the transferred medium.

8. An image forming apparatus, comprising:

a transferred unit on which a visible image is formed;

a transferring unit to form a transfer region through which the visible image is transferred onto a print medium, along with the transferred unit;

a bias supplying unit to supply bias to the transferring unit so that a transfer electric field is produced in the transfer region; and a controller to control the bias supplying unit to supply different biases to the transferring unit in correspondence to a change of posture of the print medium while the print medium passes through the transfer region.

9. The image forming apparatus according to claim 8, wherein, when one region of the print medium deviates from a normal path and passes through the transfer region along an over-transfer path near the transferring unit, the controller controls the bias supplying unit to supply a second bias having an absolute value smaller than that of a first bias applied during a normal path of the transferring unit.

10. The image forming apparatus according to claim 8, wherein the bias is varied depending on at least one of ambient temperature/humidity, thickness of the print medium, use time of the transferring unit, and a print mode of the print medium.

11. The image forming apparatus according to claim 8, wherein, when one region of the print medium deviates from a normal path and passes through the transfer region along an under-transfer path near the transferred unit, the controller controls the bias supplying unit to supply a third bias having an absolute value larger than that of a first bias of the normal path of the transferring unit.

12. A control method of an image forming apparatus including a transferred unit on which a visible image is formed, and a transferring unit to form a transfer region through which the visible image is transferred onto a print medium, along with the transferred unit, comprising:

sensing an attribute of the print medium; and supplying different first to third biases to the transferring unit while at least first to third regions of the print medium pass through the transfer region, according to the attribute of the print medium, wherein the first to third regions of the print medium have different entrance angles with respect to the transfer region.

13. The control method according to claim 12, wherein the at least first to third regions of the print medium are divided based on whether the entrance angle of the print medium into the transfer region and the transfer electric field are changed while the print medium passes through the transfer region.

14. The control method according to claim 12, wherein the first to third regions respectively correspond to a leading end region, a middle region, and a tail end region of the print medium on the basis of a travel direction of the print medium, and wherein an absolute value of the second bias is larger than an absolute value of the first bias and an absolute value of the third bias is smaller than the absolute value of the first bias.

15. The control method according to claim 12, wherein the first to third regions respectively correspond to a leading end region, a middle region, and a tail end region of the print medium on the basis of a travel direction of the print medium, and wherein an absolute value of the second bias is larger than an absolute value of the first bias and an absolute value of the third bias is larger than the absolute value of the second bias.

16. The control method according to claim 12, wherein the first to third regions respectively correspond to a leading end region, a middle region, and a tail end region of the print medium on the basis of a travel direction of the print medium, and wherein an absolute value of the second bias is smaller than an absolute value of the first bias and an absolute value of the third bias is smaller than the absolute value of the second bias.

17. The control method according to claim 12, wherein the first to third biases are varied depending on at least one of ambient temperature/humidity, thickness of the print medium, use time of the transferring unit, and a print mode of the print medium.

18. A control method of an image forming apparatus including a transferred unit on which a visible image is formed, and a transferring unit to form a transfer region through which the visible image is transferred onto a print medium, along with the transferred unit, comprising:

applying a first bias to the transferring unit;

maintaining the first bias in the transferring unit if a posture of the print medium is not changed; and applying a second bias different from the first bias to the transferring unit if the posture of the print medium is changed.

19. The control method according to claim 18, wherein, when one region of the print medium deviates from a normal path and passes through the transfer region along an over-transfer path near the transferring unit, the applying of the second bias comprises applying a second bias having an absolute value smaller than that of the first bias to the transferring unit.

20. The control method according to claim 18, wherein the second bias is varied depending on at least one of ambient temperature/humidity, thickness of the print medium, use time of the transferring unit, and a print mode of the print medium.

21. The control method according to claim 18, wherein, when one region of the print medium deviates from a normal path and passes through the transfer region along an under-transfer path near the transferring unit, the applying of the second bias comprises applying a third bias having an absolute value larger than that of the first bias to the transferring unit.

* * * * *